US011148001B2

(12) United States Patent
Nurge

(10) Patent No.: US 11,148,001 B2
(45) Date of Patent: Oct. 19, 2021

(54) EXERCISE SYSTEM

(71) Applicant: William J. Nurge, Ketchum, ID (US)

(72) Inventor: William J. Nurge, Ketchum, ID (US)

( * ) Notice: Subject to any disclaimer, the term of this patent is extended or adjusted under 35 U.S.C. 154(b) by 0 days.

(21) Appl. No.: 16/522,506

(22) Filed: Jul. 25, 2019

(65) Prior Publication Data

US 2021/0023413 A1 Jan. 28, 2021

(51) Int. Cl.

| | |
|---|---|
| ***A63B 21/08*** | (2006.01) |
| ***A63B 21/072*** | (2006.01) |
| ***A63B 21/055*** | (2006.01) |
| ***A63B 21/00*** | (2006.01) |
| ***A63B 21/04*** | (2006.01) |
| ***A63B 21/06*** | (2006.01) |
| ***A63B 15/00*** | (2006.01) |

(Continued)

(52) U.S. Cl.

CPC ..... *A63B 21/08* (2013.01); *A63B 15/00* (2013.01); *A63B 21/00043* (2013.01); *A63B 21/0442* (2013.01); *A63B 21/0557* (2013.01); *A63B 21/0609* (2013.01); *A63B 21/072* (2013.01); *A63B 21/1618* (2013.01); *A63B 21/4035* (2015.10); *A63B 23/0355* (2013.01)

(58) Field of Classification Search

CPC ..... A63B 21/0555; A63B 21/0557; A63B 21/00043; A63B 21/4043; A63B 5/20; A63B 23/03533; A63B 21/00069; A63B 21/4035; A63B 2225/09; A63B 23/1209; A63B 2023/006; A63B 21/0023; A63B 21/002; A63B 21/08; A63B 21/1618; A63B 21/0609; A63B 15/00; A63B 23/0355; A63B 21/072; A63B 21/0442

See application file for complete search history.

(56) References Cited

U.S. PATENT DOCUMENTS

| | | | |
|---|---|---|---|
| 1,826,944 | A | 10/1931 | James |
| 2,181,979 | A | 12/1939 | Schaeffer |

(Continued)

FOREIGN PATENT DOCUMENTS

| | | | |
|---|---|---|---|
| CN | 202263367 | U | 6/2012 |
| GB | 244013 | A | 12/1925 |
| KR | 2009002975 | U | 3/2009 |

OTHER PUBLICATIONS

Merriam-Webster Dictionary "https://www.merriam-webster.com/dictionary/spindle" (Year: 2020).*

*Primary Examiner* — Nyca T Nguyen
*Assistant Examiner* — Andrew M Kobylarz
(74) *Attorney, Agent, or Firm* — Parsons Behle & Latimer

(57) ABSTRACT

An exercise system includes a handle having a shaft, a head, a spindle, and a loop. The shaft extends from a first end to a second end. The head has a top, a bottom, a front, and a rear, the top opposite the bottom, the front opposite the rear, the bottom of the head affixed to the second end of the shaft. The spindle has a ring and is positioned at the front of the head with the spindle rotatably supported upon the head. The loop is affixed to the top of the head. The exercise system includes one or more elastic exercise cords configured to selectively connect to the loop or the ring. The exercise system may include one or more kettleballs configured to selectively connect to the one or more elastic exercise cords. The kettleballs and/or elastic exercise cords may be moved in a circular motion.

25 Claims, 29 Drawing Sheets

(51) Int. Cl.
*A63B 21/16* (2006.01)
*A63B 23/035* (2006.01)

(56) References Cited

U.S. PATENT DOCUMENTS

| | | | | |
|---|---|---|---|---|
| 2,307,905 | A | 1/1943 | Ament | |
| 2,942,881 | A * | 6/1960 | Recalma | A63B 5/20 482/82 |
| 2,944,817 | A | 7/1960 | Stiller | |
| 2,979,858 | A | 4/1961 | Holman, Jr. | |
| 3,427,023 | A * | 2/1969 | Silberman | A63B 21/4035 482/139 |
| 3,428,325 | A | 2/1969 | Atkinson | |
| 3,517,931 | A * | 6/1970 | Barton | A63B 5/20 482/82 |
| 3,531,115 | A | 9/1970 | Alexander | |
| 3,907,287 | A | 9/1975 | Fox et al. | |
| 4,092,799 | A | 6/1978 | Anderson | |
| 4,145,046 | A | 3/1979 | Jones | |
| 4,186,921 | A | 2/1980 | Fox | |
| 4,577,864 | A | 3/1986 | Aldrich | |
| 4,664,388 | A | 5/1987 | Huber | |
| 4,878,673 | A | 11/1989 | Pollard | |
| 5,211,612 | A | 5/1993 | Carbonero | |
| 5,433,435 | A | 7/1995 | Bourie | |
| 5,615,879 | A | 4/1997 | Bailey | |
| 5,885,196 | A * | 3/1999 | Gvoich | A63B 21/0004 482/122 |
| 6,401,665 | B1 | 6/2002 | Gentile | |
| 6,524,226 | B2 | 2/2003 | Kushner | |
| 7,044,896 | B2 | 5/2006 | Hetrick | |
| 7,090,622 | B2 | 8/2006 | Hetrick | |
| 7,651,448 | B2 | 1/2010 | Hetrick | |
| 7,722,508 | B2 | 5/2010 | Hetrick | |
| 7,727,131 | B2 * | 6/2010 | Longo | A63B 21/169 482/124 |
| 7,762,913 | B1 * | 7/2010 | Hagen | A63B 69/0002 473/457 |
| 7,762,932 | B2 | 7/2010 | Hetrick | |
| 7,785,244 | B2 | 8/2010 | Hetrick | |
| 7,806,814 | B2 | 10/2010 | Hetrick | |
| 8,043,197 | B2 | 10/2011 | Hetrick | |
| 8,083,653 | B2 | 12/2011 | Hetrick | |
| 8,409,061 | B2 | 4/2013 | Chen | |
| 8,469,864 | B2 | 6/2013 | Hetrick | |
| 8,840,532 | B2 | 9/2014 | Hetrick et al. | |
| 9,155,931 | B2 | 10/2015 | Hetrick | |
| 9,180,333 | B2 | 11/2015 | Dipace et al. | |
| 9,433,258 | B2 | 9/2016 | Hetrick et al. | |
| 10,245,460 | B2 | 4/2019 | Hetrick et al. | |
| 2004/0002408 | A1 | 1/2004 | Rigas | |
| 2010/0130313 | A1 | 5/2010 | Bastian | |
| 2011/0124441 | A1 | 5/2011 | Fang | |
| 2011/0237360 | A1 | 9/2011 | Dodson | |
| 2011/0306474 | A1 * | 12/2011 | Gamboa | A63B 5/20 482/81 |
| 2013/0190145 | A1 | 7/2013 | Kugielsky | |
| 2014/0228180 | A1 * | 8/2014 | Walker | A63B 21/065 482/82 |
| 2017/0021224 | A1 * | 1/2017 | Barton | A63B 21/4035 |
| 2017/0087395 | A1 | 3/2017 | Kinziger | |
| 2019/0091507 | A1 | 3/2019 | Hetrick et al. | |

* cited by examiner

EXERCISE SYSTEM

FIELD OF THE DISCLOSURE

The embodiments described herein relate generally to exercise equipment. In particular, the disclosure relates to an adjustable and portable exercise system for resistance training in multiple planes of motion.

BACKGROUND

Aging can result in a diminution in strength, mobility, cardiovascular capacity, balance, coordination, three-dimensional movement capabilities, bone-density, and/or muscle-density. Exercise and other training programs are directed to overcoming or mitigating these diminutions. To perform everyday activities and sports, the body performs movements of varying speeds and loads simultaneously in three planes of motion: a sagittal plane, a transverse plane, and a frontal plane. However, known strength-training programs and devices may train the body in only one plane of motion, at a single speed (or no speed), and/or focus on a single muscle group at a time. For example, push-ups and pull-ups strengthen in the sagittal plane, but are ineffective in the transverse and frontal planes. These exercises may also be inefficient and time-consuming. Jumping rope, front planks, and sit-ups/crunches likewise creates movement and loads in only the sagittal plane. Side planks/crunches and "Russian Twists" (lying on back and twisting side to side) likewise challenge only the frontal plane and traverse planes, respectively.

Physiological changes concomitant to the aging process include joint stiffness and a diminution in the ability to move effectively in three dimensions. A reduction in the functional mobility of a joint in the body can affect other joints that are interconnected and result in a loss of the ability to move the body freely through functional ranges of motion. One of the physiological byproducts of aging can be osteoporosis, which is a progressive demineralization and loss of integrity in the skeletal structure of the human body. Maintaining bone-density is important to reduce the consequences, including hip fractures, from falling. Likewise, age-related diminution in muscle mass, known as sarcopenia, adversely affects the human body. For example, a sedentary 80-year-old may lose 50% of the muscle mass they had when they were 20 years old.

Heart disease is a leading cause of death in the U.S., claiming over half a million lives per year. Rhythmical endurance activities can help offset age-related reductions in heart function and health. Rope-skipping, also known as jump roping, is a convenient and excellent aerobic exercise, but many older individuals may not enjoy it, and many simply cannot coordinate the downward arm movement with the upward leg jump to successfully perform this activity. Moreover, jump roping is counter intuitive to the body as the arms are swung downward as the legs jump upward, which also results in compression of the lumbar spine. Furthermore, due to the loss of leg strength and power associated with aging, many older individuals lack the ability to jump up and leave the ground, even when jumping properly, which makes it virtually impossible to successfully jump over a rope when the hands and arms are swinging down. Jump-less jump ropes utilize a short inelastic cord that is not jumped over but is operated in a similar manner to other jump ropes. In addition, due to the nature of known jump rope handles, both jump ropes and jump-less jump ropes place the user's hands in a palms-up position to spin the rope. Loading the user's body with palms-up position and elbows close to the side of the body is not optimal for functionally conditioning the upper body and core-musculature in multiple planes of motion. Other disadvantages of known exercise systems may exist.

Figure 1:
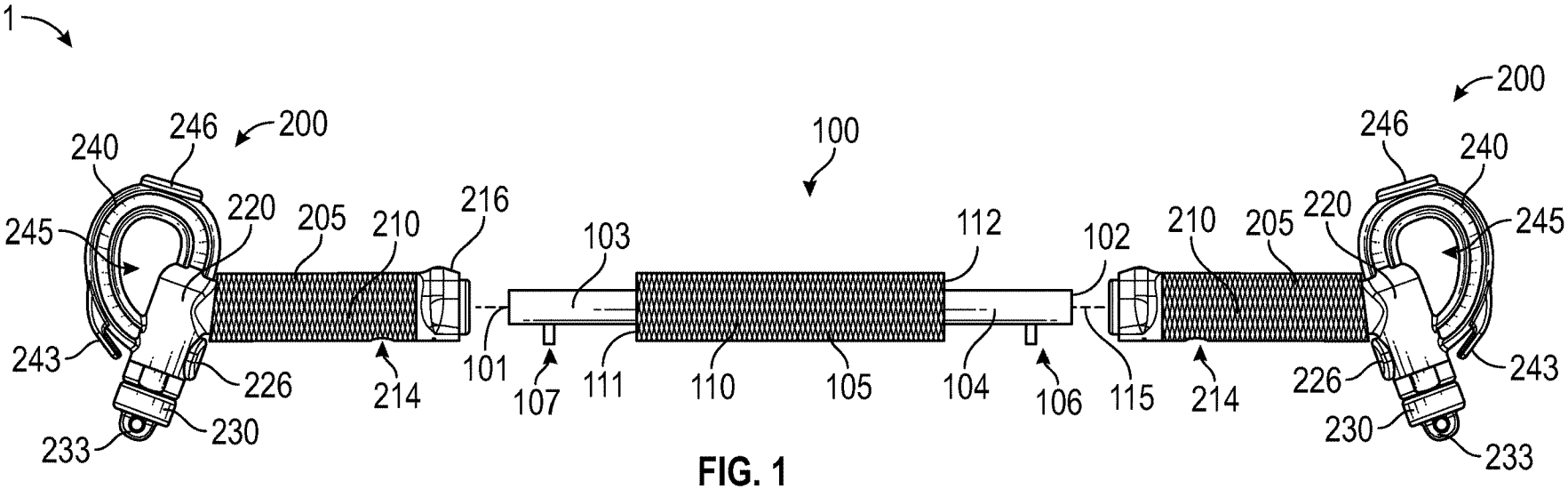
FIG. 1 is an exploded view of an embodiment of an exercise system with a bar and a pair of handles.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

SUMMARY

The exercise systems described herein provide an effective, portable, and interactive solution to help people, older adults in particular, mitigate age-related reductions in physical capacities. Embodiments of exercise systems described herein provide an overload for training at a variety of movement speeds, tension levels, and multi-dimensional movement patterns in an effort to improve multi-dimensional strength, balance, coordination, and mobility, which leads to improvements in the ability to perform activities and sports. Unlike many known strength-training programs and devices, which isolate muscle groups in a single plane, the exercise systems may facilitate training within three-dimensional movements, which engage many muscles simultaneously.

Embodiments of exercise systems described herein may improve functional mobility by teaching the body to move three dimensionally through full ranges of motion against loads of varying resistance, force vectors, and velocities. Exercise systems may provide for a more efficient aerobic exercise, similar to Nordic skiing, by metabolically challenging many muscle groups simultaneously. For instance, to jump upward in a bio-mechanically efficient way includes accelerating the hands and legs down simultaneously to increase ground-reactive force and then, milliseconds later, accelerating the hands and arms upward while the legs push into the ground and create a coordinated and powerful upward jump.

The exercise systems may include one or more handles attached to exercise cords, which are attached to kettleballs. The kettleballs may be formed of foam, such as polyurethane foam. The kettleballs are sized sufficiently larger than a typical orbital socket of a user to avoid inadvertent injury to an eye during use. A user may swing their hands and arms downward, which make the kettleballs accelerate down at the same time the hips and knees are dropping down, to increase ground reactive force. Subsequently, the hands, arms and kettleballs accelerate upward at the same moment the hips and user's center of mass are accelerated upward. Because there is no rope to jump over, the user never misses a jump and thereby can continue jumping, or stepping, without interruption in a variety of movement patterns including side-to-side jumping, single-leg jumping, split-squat jumping, alternating high-knee jumping, and wide/sumo squat jumping. The user moves the kettleballs in a variety of spinning patterns. The user may also move the kettleballs at varying speeds to vary the force vectors. For instance, a rate of rotation may be doubled, which quadruples the centripetal force, and cause the exercise cord to elongate. Unlike known rope and rope-less systems, which a user relies on wrist muscles to spin the rope, the embodiments herein may utilize three-dimensional body movement to spin the kettleballs. The handle accommodates a stable, non-moving wrist position and core musculature functionally initiates and perpetuates the movement of the kettle balls. Movement of the handle and kettleballs in the spinning patterns facilitates movements in all three planes of motion and may increase coordination and stamina. Separate handles and kettleballs may be moved in a torsionally resonating syncopated rhythm to produce a functional and multi-dimensional overload. Using multiple exercise cords and/or kettle balls with a single handle provides a heavier overload that may simulate swinging a golf club or a baseball bat.

A user's hands may be positioned in a variety of hand and elbow configurations relative to the body so the exercise cord and kettleball can be swung in many different planes of motion. For instance, a user's hands may be alternated between palms-up, palms-down, and palms-facing each other positions.

In some embodiments, a long exercise cord can be attached to the handles to jump over while spinning. However, unlike some known jump ropes, which utilize an inelastic cord, the elastic exercise cord generates greater ground force as potential energy is converted to kinetic energy during acceleration of the cord. A user may stand upon the longer exercise cord and move the handles against the resistance of the long exercise cord. In some embodiments, multiple exercise cords can be attached to the handles to jump over while spinning. Due to the configuration of the handles, a variety of hand positions and exercises may be performed while pushing or pulling against the resistance of the cord.

Exercises performed with embodiments of the exercise system may challenge the body's ability to balance both bilaterally on two legs and unilaterally on one leg. Accelerating the exercise cords in a variety of spinning patterns challenges the vestibular and nervous systems of the body to counter-balance the spinning kettleball and thereby can lead to improvements in the ability to balance dynamically under a variety of situations. Improving balance can reduce the risk of falling and getting injured in older adults. Exercises performed with embodiments of the exercise system may challenge the body's ability to coordinate the arms, legs, and core to work together simultaneously. Maintaining and/or improving total-body coordination is important for maintaining the ability to perform everyday tasks and sports effectively.

Exercises performed with embodiments of the exercise system may increase bone-density in aging adults by applying jolting forces which cause the body to maintain and/or improve bone-density. Exercises utilizing the handles for syncopated jolting push-ups, and varying resistance exercise cords with a variety of kettleballs, may enable the user to effectively apply overload to the axial skeleton, which may result in mitigating decreases in bone density. Much of the age-related diminution in muscle mass can be prevented by consistently performing multi-dimensional exercises of varying loads and speeds. The embodiments of the exercise system are designed to functionally—three-dimensionally and in a resonating pattern—overload the body's musculature in a way that stimulates the production and/or retention of the muscles contractile tissue (actin and myosin filaments), which improves and/or preserves muscle-density/mass.

Three drivers of muscle hypertrophy are i) total time under tension, ii) metabolic overload, and iii) mechanical overload. Two or more of these drivers are engaged when utilizing elastic or inelastic embodiments of the exercise system for strength training.

Exercises utilizing the handles and/or bar with an elastic exercise cord, or inelastic rabbit runner, connected to the daisy chain in various positions provide light, medium, or high-tension three-dimensional overloading. Also, the bar and rabbit runner facilitate resonating, syncopated pulling and pushing movements which engage more of the body's rotational musculature and facial oblique slings. Torsional resonance (axially rotating the body while side-bending and hip-hinging) is facilitated by the elastic and inelastic embodiments of the exercise system for functional training.

An embodiment of an exercise system includes a handle having a shaft, a head, a spindle, and a loop. The shaft extends from a first end to a second end. The head has a top, a bottom, a front, and a rear, the top opposite the bottom, the front opposite the rear, the bottom of the head affixed to the second end of the shaft. The spindle has a ring. The spindle is positioned at the front of the head and is rotatably supported upon the head. The loop is affixed to the top of the head.

The loop may be further affixed to the rear of the head. The loop may extend arcuately from the top of the head to the rear of the head. The bottom of the head may include a finger pad positioned between the shaft and the spindle, to support an index finger of a hand when the index finger may be wrapped at least partially around the first end of the shaft. The loop may be sized to receive a thumb of a hand. A distance from the top to the bottom of the head may permit the thumb to be received through the loop while the index finger of the hand may be wrapped at least partially around the second end of the shaft.

The loop may include a first portion and a second portion. The first portion is closer to the spindle than the second portion. The second portion may include a flattened profile positioned to support the handle upon a surface with the shaft at an acute angle with respect to the surface. The acute angle may be in a range of 5 to 30 degrees.

The first portion may include a notch. The exercise system may include a wrist strap. A portion of the wrist strap is connected to the loop. The notch of the loop is positioned to retain the portion of the wrist strap on the first portion of the loop. A portion of the notch may extend along the loop to form a slot extending along the loop to receive the portion of the wrist strap.

The shaft extends along a first axis from its first end to its second end, the head extends along a second axis from its front to its rear. The first axis may be not perpendicular or parallel to the second axis. The first axis and the second axis may be angularly offset in a range of 15 to 45 degrees. The shaft may be sized to accommodate two hands side-by-side. The spindle may include a body with a top. The ring may extend from the top and having a first side and second side with an aperture extending therebetween. The top may have a concave shape.

The exercise system may include one or more elastic exercise cords configured to selectively connect to the loop or the ring. The one or more elastic exercise cords each may include a carabiner sized to selectively connected to the ring. The spindle may include a body with a top. The ring extends from the top and has a first side and second side with an aperture extending therebetween. The top may have a diameter greater than a width of the carabiner. The one or more elastic exercise cords may include an elastic exercise cord having a length of one to nine feet. The elastic exercise cord has a length of one to two feet. The elastic exercise cord has a length of four to six feet.

The exercise system may include one or more kettleballs configured to selectively connect to the one or more elastic exercise cords.

The one or more kettleballs may each have a body and a passageway extending through the body. The one or more kettleballs may have a diameter of 2.5 inches or greater. The one or more elastic exercise cords may include an elastic exercise cord having a length of four feet or greater. The elastic exercise cord may have a length of four to nine feet.

The exercise system may include a bar having a first end, a second end, and a body positioned between the first end of the bar and the second end of the bar. The first end is shaped complementary to the shaft of the handle to be selectively retained with the handle.

The exercise system may include a second handle having a shaft, a head, a spindle, and a loop. The shaft extends from a first end to a second end. The head has a top, a bottom, a front, and a rear, the top opposite the bottom, the front opposite the rear, the bottom of the head affixed to the second end of the shaft. The spindle has a ring. The spindle is positioned at the front of the head and is rotatably supported upon the head. The loop is affixed to the top of the head The exercise system may include a daisy chain having a first end, a second end, and a plurality of loops extending towards the second end. The plurality of loops may be at least 18 loops. Each of the plurality of loops may have a length of approximately 2". The daisy chain may be formed of an inelastic material.

The exercise system may include a rabbit runner having a first end having a first loop; a second end having a second loop; and a pair of center loops near a midpoint between the first end and the second end. The rabbit runner may include one or more mid-loops between the pair of center loops and the first loop, and one or more mid-loops between the pair of center loops and the second loop. The rabbit runner may be formed of an inelastic material.

An embodiment of an exercise handle includes a head, a loop, a ring, and a shaft. The loop is affixed to the head. The loop is configured to connect to a first elastic exercise cord having a first resistance rating. The ring is rotatably supported upon the head. The ring is configured to connect to a second elastic exercise cord having a second resistance rating, the first resistance rating exceeding the second resistance rating. The shaft has a length extending from a first end to a second end, the second end affixed to the head, the shaft sized to receive at least one hand along its length.

The shaft may be sized to receive two hands along its length. The loop may be sized to receive a thumb of a hand. The shaft extends along a first axis from its first end to its second end, the head extends along a second axis from a front to a rear. The ring is disposed at the front. The first axis may not be perpendicular or parallel to the second axis. The first axis and the second axis may be angularly offset in a range of 15 to 45 degrees.

The head may include a top and a bottom, the top opposite the bottom, the bottom of the head affixed to the first end of the shaft, the loop may include a first portion and a second portion, the first portion closer to the ring than the second portion. The second portion may include a flattened profile positioned to support the exercise handle upon a surface with the shaft at an acute angle with respect to the surface. The flattened profile may be an elastically deformable pad.

The ring may be rotatably supported upon a spindle, the spindle may include a body with a top, the ring extending from the top and having a first side and second side with an aperture extending therebetween. The top may have a concave shape.

An embodiment of a method of utilizing an exercise system includes attaching a first end of an elastic exercise cord to a kettleball and attaching a handle to a second end of the elastic exercise cord. The method handle includes a head, a loop affixed to the head, and a spindle having a ring rotatably supported upon the head. The second end of the elastic exercise cord may be attached to the spindle of the handle, the method may include spinning the kettleball in a circular pattern around the handle.

The method may include attaching a first end of a second elastic exercise cord to the handle, attaching a second end of the second elastic exercise cord to a support, and moving the handle against a resistance of the second elastic exercise cord.

The method may include attaching a first end of a second elastic exercise cord to the handle, attaching a second end of the second elastic exercise cord to a second handle, and moving the second elastic exercise cord in a circular motion, the circular motion passing underneath a user.

DESCRIPTION

The present disclosure is related to exercise systems and devices and training programs directed to training a body in multiple planes of motion. More particularly, the present disclosure is related to an interchangeable exercise device to use for training that overcomes some of the problems and disadvantages discussed above.

Figure 2:
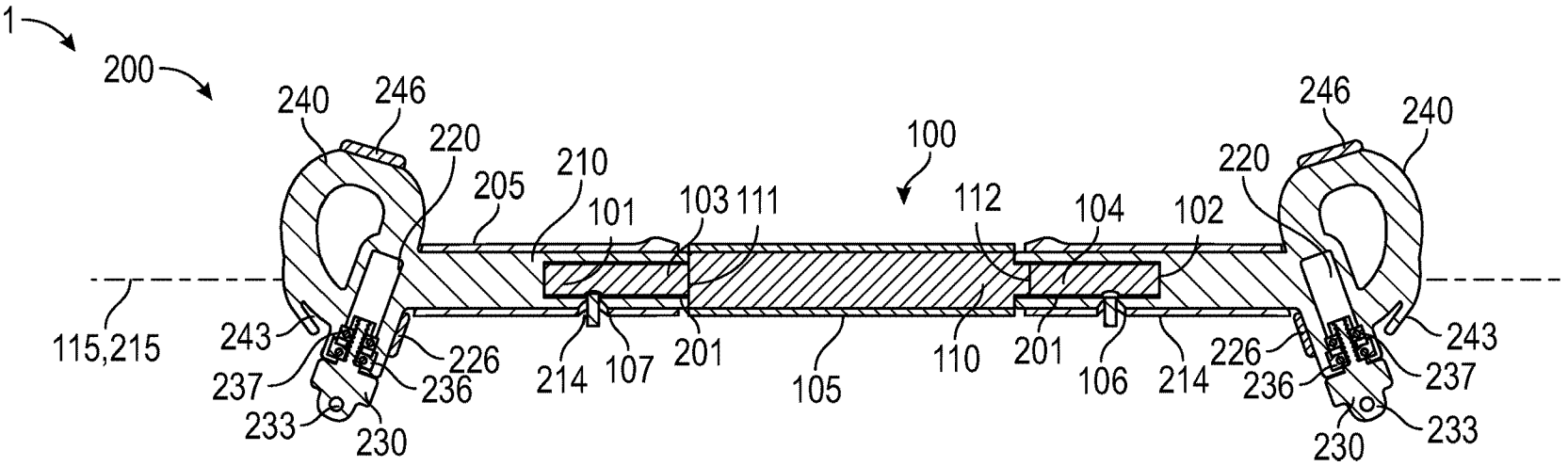
FIG. 2 is a cross-sectional view of the embodiment of FIG. 1.

FIG. 1 shows an embodiment of an exercise system 1. FIG. 2 is a cross-sectional view of the exercise system 1 shown in FIG. 1. The exercise system 1 includes a bar 100 and one or more handles 200, such as a pair of handles 200. The bar 100 includes a first end 101 and a second end 102 with a first axis 115 extending from the first end 101 to the second end 102. The first end 101 is shaped complementary to at least one of the pair of handles 200 to be selectively retained with the handle 200. The second end 102 is shaped complementary to at least one of the pair of handles 200 to be selectively retained with the handle 200. The first end 101 may have the same shape as the second end 102 to permit the handles 200 to be interchangeably positioned. As shown in FIG. 1, the bar 100 may include a first protrusion 103, a second protrusion 104, and a body 105. The body 105 may be positioned axially between the first protrusion 103 and the second protrusion 104. The first end 101 may be on the first protrusion 103. The second end 102 may be on the second protrusion 104. The body 105 may have a cylindrical shape extending from a first side 111 to a second side 112. The first protrusion 103 extends from the first side 111, and the second protrusion 104 extends from the second side 112. The first protrusion 103 and/or second protrusion 104 may have a cylindrical shape. The exercise system 1 may include a grip sleeve 110 disposed on an exterior surface of the body 105. In some embodiments, the grip sleeve 110 may be integrally formed into the body 105. The first protrusion 103 may include a first spring-loaded button 107 operable to engage the handle 200 to selectively retain the handle 200 with the first protrusion 103. The second protrusion 104 may include a second spring-loaded button 106 operable to the engage the handle 200 to selectively retain the handle 200 with the second protrusion 104.

Handle 200 is configured to connect to first end 101 and/or second end 102 of bar 100. Handle 200 may be selectively retained on the first end 101 via the first spring-loaded button 107 received through a hole 214 of handle 200. Handle 200 may be selectively retained on the second end 102 via the second spring-loaded button 106 received through the hole 214 of handle 200. Each handle 200 includes a shaft 210 and a head 220. Shaft 210 includes a grip sleeve 205. In some embodiments, grip sleeve 205 may be integral to shaft 210. Shaft 210 is shaped complementary to at least one of the first end 101 and the second end 102 of the bar 100 to be selectively retained with the bar 100. In some embodiments, shaft 210 of handle 200 may be retained with the bar 100 via a snap fit, a threaded fit, or a pinned connection, such as a spring-loaded button. As shown in FIG. 2, shaft 210 may include a cavity 201 shaped to receive the first protrusion 103 of the bar 100. When the first protrusion 103 is inserted sufficiently far into the cavity 201, the first spring-loaded button 107 is biased outward and engages a hole 214 in the shaft to selectively retain the first protrusion 103 within the shaft 210. It is appreciated that in some embodiments, the complementary relationship between the bar 100 and the handle 200 may be reversed on one or both ends. For instance, a cavity may be included on the first protrusion 103 and shaft 210 of handle 200 may be received within the first protrusion 103. The grip sleeve 205 may be disposed on the exterior of first protrusion 103 to provide a surface for the user to hold during operation.

Referring again to FIG. 1, the head 220 of the handle 200 includes a spindle 230 and/or a loop 240. In some embodiments, the head 220 includes both the spindle 230 and the loop 240 to provide for a variety of exercises and connections within a single apparatus.

Spindle 230 rotatably supports a ring 233 with an aperture 235. Ring 233 is sized to receive a carabiner. Loop 240 is rigid and forms an aperture 245 and is not rotatable. In other words, the orientation of loop 240 does not change with respect to head 220 and loop 240 is affixed to head 220. Ring 233 and loop 240 each provide a connection point for an exercise cord. As used herein, the term "exercise cord" refers to an elastic cord. For the purposes of this disclosure, a material is elastic if its length is stretchable at room temperature (23° C.) to at least 120% of its original length without permanent deformation. The elastic exercise cords may be elastomeric cords. It is appreciated that embodiments described herein may be utilized with inelastic cords but may be less advantageous for exercising, as would be appreciated by one of ordinary skill in the art having the benefit of this disclosure. Loop 240 may be configured to connect to exercise cords having a higher resistance rating. For example, a first cord may have a relatively light resistance rating and a second cord may have a relatively high resistance rating. The first cord may be connected to either ring 233 or loop 240 for different exercises. However, exercises using the second cord may exceed the strength of ring 233 and therefore may be connected to only loop 240 to avoid damage to the spindle 230. By way of example, loop 240 may be rated to withstand up to 500 pounds of force and ring 233 may be rated to handle up to 300 pounds of force. Loop 240 may be configured to connect to an overhead support and a user may grasp bar 100 and/or one or both handles 200 to perform pull-ups.

In some embodiments, the ring 233 of spindle 230 may be designed to accommodate the same loads as loop 240. In some embodiments, loop 240 may be omitted. For instance, a head and shaft of spindle 230 may be formed of a single piece of forged steel. The shaft of spindle 230 may be an 8 mm (3.15") shaft and an endcap or thrust bearing may be utilized to prevent axial movement of ring 233. Exercises performed with exercise cords 300 (shown in FIG. 4) can be performed by attaching a primary carabiner to ring 233 of spindle 230. Additional exercise cords 300 can be attached to the primary carabiner or passed through loop 240.

Head 220 may include a finger pad 226 positioned adjacent to shaft 210 to support and cushion a user's hand 5 when holding the handle 200. Loop 240 may include a flattened profile, such as an elastically deformable pad 246, to support the handle 200 upon the loop 240 and the shaft 210 when the user is performing a pushup. Shaft 210 may include a stabilizing pad 216 near a first end 211 positioned to support the handle 200, in addition to pad 246, when the user is performing a pushup. Loop 240 may include a notch 243 shaped to selectively retain a strap 250 (shown in FIG. 5A).

As shown in FIG. 2, an axis 215 of shaft 210 of handle 200 is aligned with axis 115 of bar 100. The head 220 of shaft 210 rotatably supports spindle 230. Head 220 may include a dual-bearing configuration to support spindle 230. The dual-bearing configuration may be formed of a first ball bearing 236 and a second ball bearing 237.

Figure 3:
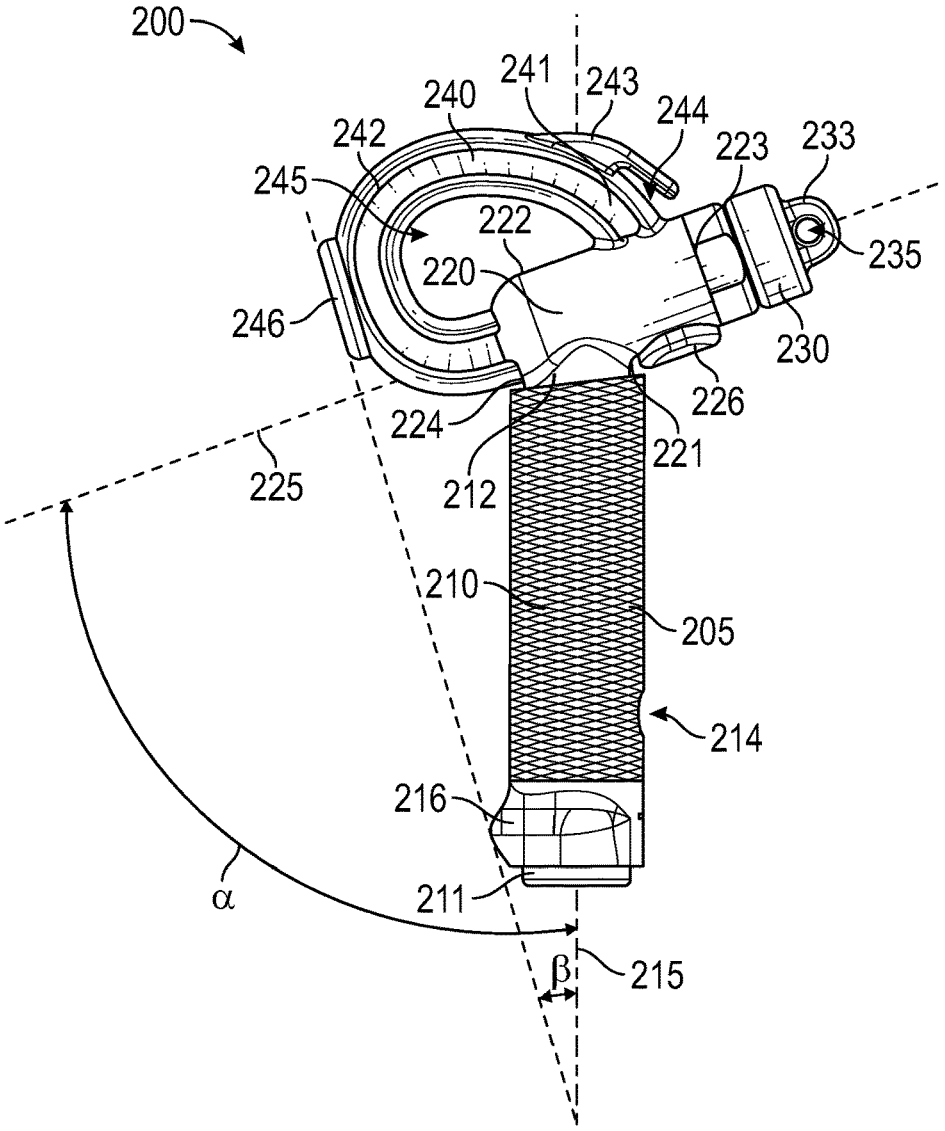
FIG. 3 shows an embodiment of a handle of an exercise system

FIG. 3 shows an embodiment of a handle 200. Handle 200 includes a shaft 210 and a head 220. Shaft 210 has a first end 211 and a second end 212. Shaft 210 has a length extending along an axis 215 from first end 211 to second end 212. Shaft 210 is sized to receive at least one hand 5 of a user. Shaft may be sized to simultaneously receive two hands. Shaft 210 may be cylindrical-shaped. Shaft 210 may include a grip sleeve 205. Shaft 210 may include a hole 214 configured to receive spring-loaded button 107 and/or spring-loaded button 106 of bar 100 (shown in FIG. 1). Shaft 210 may include a stabilizing pad 216 protruding from one side of the shaft 210 perpendicular to its length. Stabilizing pad 216 may inhibit a user's hand 5 from sliding too far down the shaft 210 during use. Stabilizing pad 216 may also be used to support handle 200 when used in exercises where the handle 200 is placed against a surface, such as the ground.

Head 220 includes a bottom 221, a top 222, a front 223, and a rear 224. The bottom 221 is opposite the top 222. The front 223 is oppose the rear 224. An axis 225 extends from the front 223 to the rear 224. Head 220 includes a length extending along axis 225 from the front 223 to the rear 224. Head 220 includes a height extending from bottom 221 to top 222. The length may be greater than the height to form an elongated head 220. Bottom 221 of head 220 is affixed to second end 212 of shaft 210. Head 220 may be cylindrical. Finger pad 226 may be positioned on bottom 221 of head 220 to support an index finger of a hand 5 when the index finger is wrapped at least partially around second end 212 of shaft 210.

Axis 225 of head 220 and axis 215 of shaft 210 may not be parallel. In some embodiments, axis 215 and axis 225 are perpendicular. In some embodiments, axis 215 and axis 225 are neither perpendicular nor parallel. Axis 225 of head 220 and axis 215 of shaft 210 may be angularly offset by an acute angle $\alpha$. In some embodiments, angle $\alpha$ may be in the range of 15 to 45 degrees. Spindle 230 is rotatably disposed at front 223 of head 220. Spindle 230 is rotatable about axis 225. Spindle 230 includes a rotatably supported ring 233 with aperture 235 configured to connect to an exercise cord 300 (shown in FIG. 6).

Loop 240 is affixed to or integral to head 220 and forms an aperture 245. Aperture 245 may be sized to receive a thumb of a user's hand 5. The height from bottom 221 to top 222 of head 220 may be sufficiently small to permit the thumb of a user to be received through loop 240 while an index finger of the hand 5 is wrapped at least partially around second end 212 of shaft 210. Loop 240 may be affixed to top 222 of head 220. Loop 240 may be affixed to rear 224 of head 220. Loop 240 may extend arcuately from top 222 to rear 224 of head 220, such that a portion of loop 240 extends further along the direction of axis 225 than rear 224. Loop 240 may be used to orient the position of a user's thumb when using a thumb-high prehensile grip (shown in FIG. 5C). Loop 240 may be comprised of a first portion 241 adjacent to top 222 and a second portion 242 adjacent to rear 224. First portion 241 is closer to front 223 than second portion 242. The pad 246 is positioned on the second portion 242 such that it is on an opposite side from spindle 230. Pad 246 and stabilizing pad 216 are positioned to support handle 200 upon a surface with shaft 210 oriented at an acute angle $\beta$ with respect to the surface. Angle $\beta$ may be in the range of 5 to 75 degrees. Angle $\beta$ may be in the range of 5 to 30 degrees. The position of the pad 246 and stabilizing pad 216 along axis 225 may be selected such that the shaft 210 may be grasped and fingers to do not contact the surface during use. Pad 246 may be approximately one inch long and/or comprise rubber.

A notch 243 may be positioned on first portion 241 of loop 240. Notch 243 may be substantially aligned with axis 215 of shaft 210. A portion of notch 243 may extend along loop 240 to form a slot 244 extending along loop 240 to receive a wrist strap 250 (shown in FIG. 5A) or receiving first loop 410 or second loop 411 of a rabbit runner 400 (shown in FIG. 11).

Figure 4:
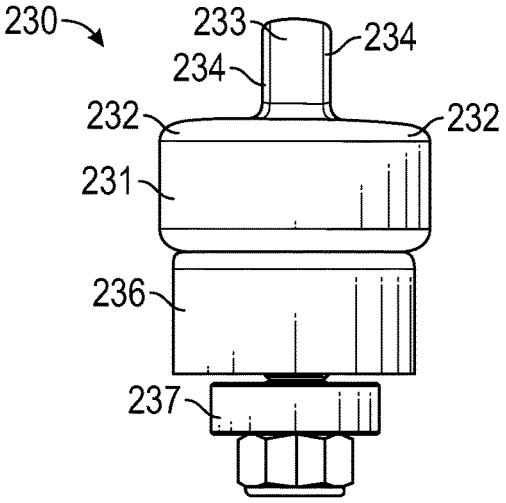
FIG. 4 shows an embodiment of a spindle of a handle.

FIG. 4 shows an embodiment of a spindle 230. Spindle 230 includes a body 231 with a top 232 and a ring 233 extending from the top 232. The ring 233 may be integrally formed into the body 231. The body 231 is rotatably supported upon the first ball bearing 236 and the second ball bearing 237. Ring 233 includes sides 234 with an aperture 235 (shown in FIG. 3) extending therebetween. Ring 233 may be a d-ring shape formed with top 232. The shape of ring 233, the length of head 220, and/or the angle $\alpha$ of offset between axis 225 of head 220 and axis 215 of shaft 210 allows rotation of exercise cord 300 without contacting the knuckles or hand 5 of a user. The diameter of top 232 is greater than a width w of a carabiner 610 (shown in FIG. 12) to be received within the aperture 235 to inhibit over-rotation of the carabiner 610. The top 232 may have a concave shape to inhibit over-rotation of the carabiner 610. The spindle 230 is constructed of materials sufficient to accommodate the force from multiple exercise cords 600, 650 (shown in FIG. 13), as well as multi-level centrifugal forces generated by spinning a kettleball 700 connected to exercise cord 600 (shown in FIG. 12). Ring 233 may be formed of a low-friction material, such as stainless steel, polytetrafluoroethylene, or acetal, to facilitate sliding movement of a carabiner 610 (shown in FIG. 12) on ring 233.

Figure 5C:
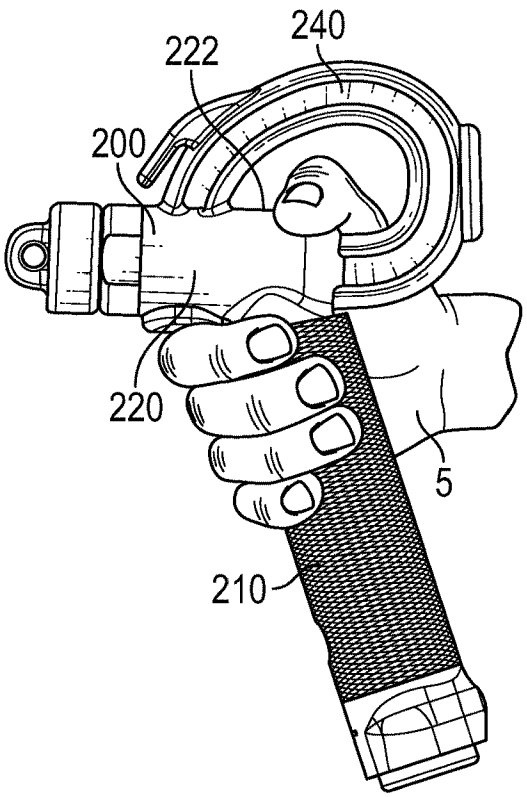
FIGS. 5A-5C show grip positions on an embodiment of a handle.
Figure 5B:
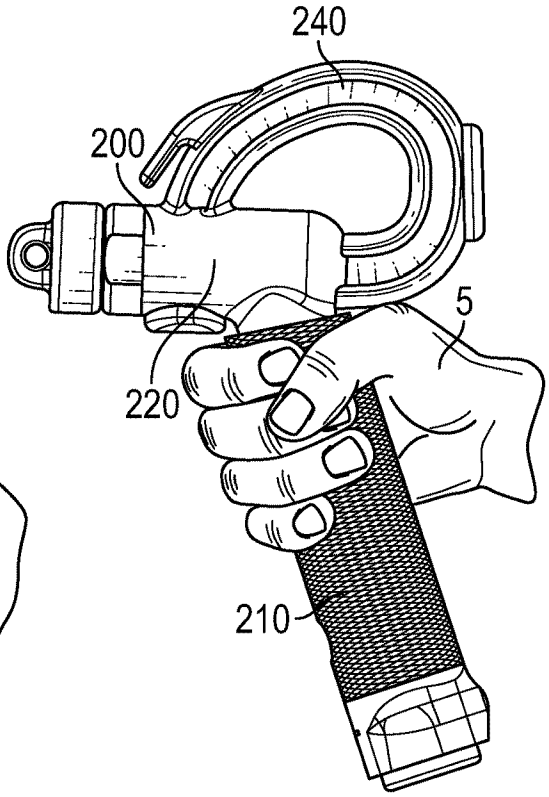
Figure 5A:
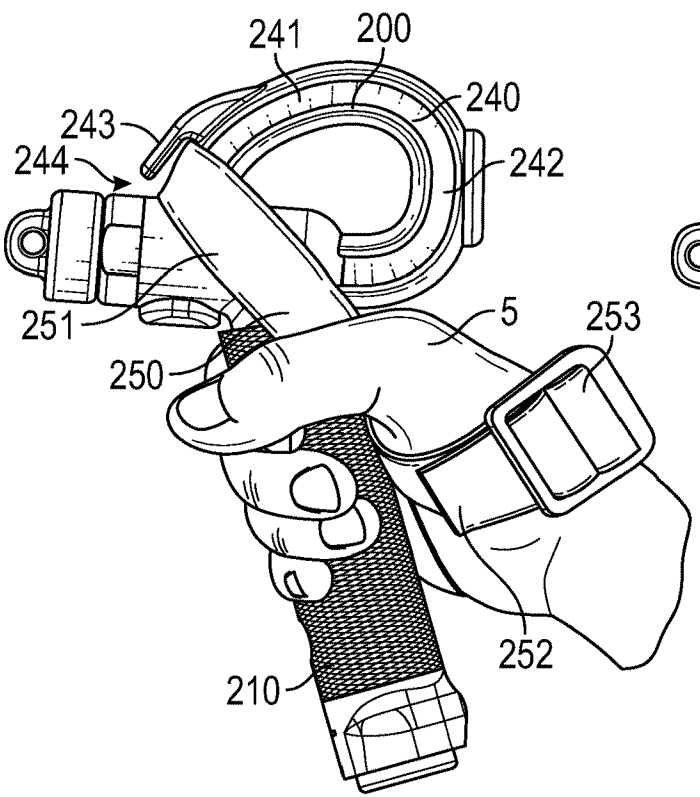

FIGS. 5A-5C show grip positions on a handle 200. Handle 200 may provide a plurality of gripping configurations that are not possible with known jump rope handles. Known jump rope handles provide an underhanded gripping configuration that is held close to the waist and activates few muscles. FIGS. 5A and 5B show handle 200 with a user's hand 5 in a vertical grip configuration. A vertical and overhand grip configuration may be particularly advantageous for alpine or Nordic skiing training, boxing, martial arts, tennis, rowing, running cycling, climbing, and other sports, where the hands can be held vertically overhead or out to the sides. The vertical grip configuration with the thumb pulled downward toward the fingers (prehensility) activates more of the arm and upper body musculature. Various gripping configurations vary the muscles used in the hand, wrist, forearm, and upper arm.

A vertical and palms-down grip configuration simulates an ergonomic hand position which may be used for sports conditioning and training upper body muscles. A variety of three-dimensional movement patterns can be employed with a single-handed or double-handed vertical grip. Throwing, chopping, hammering, and spinning movements with one or two hands can be employed to simulate everyday activities and sports.

As shown in FIG. 5A, a wrist strap 250 may be used to stabilize a user's grip. The wrist strap 250 includes a first loop 251 and a second loop 252 to form a figure-8 configuration. By way of example, wrist strap 250 may be formed of a ¾" webbing. First loop 251 is sized to fit snugly over the top of the loop 240 and around second portion 242. First loop 251 is secured into the slot 244 formed by notch 243, while being removeable. Notch 243 is positioned to retain first loop 251 of wrist strap 250 on first portion 241 (shown in FIG. 2) so that wrist strap 250 is secured during use. Second loop 252 includes an adjustment buckle 253 to accommodate different size wrists. Wrist strap 250 enables a user to brace for a single-hand handhold on handle 200. By way of example, a user doing cardiovascular training may perform single-handed kettle-ball swings or jump-bungee for extended periods of time. Wrist straps 250 may be beneficial to stabilize the wrists and forearm muscles to overcome or mitigate local muscular fatigue. Bracing a hand 5 to handle 200 may enable the user to focus on overloading the bigger muscle groups of the upper body, core, and legs without being limited by metabolic fatigue and strain in the forearm flexors and extensors responsible for stabilizing the hand. FIG. 5C shows handle 200 with a user's hand 5 in a thumb-high prehensile vertical grip configuration. Utilizing the thumb to pull downward while the remaining fingers grip can facilitate an increase in grip strength.

Figure 6:
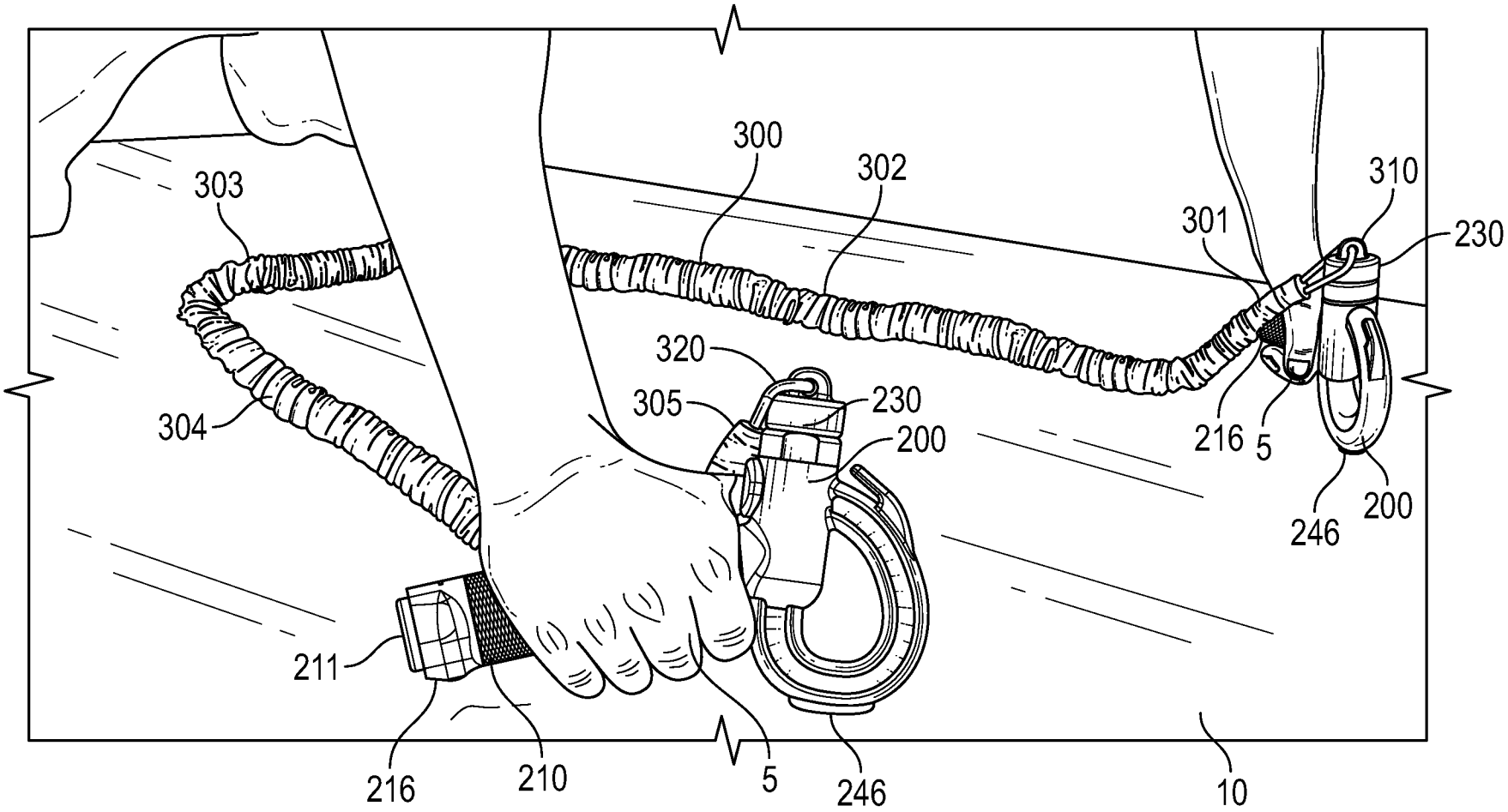
FIG. 6 shows a configuration of an exercise system with an exercise cord and a pair of handles and the exercise system in a push-up position.

FIG. 6 shows an exercise system with an exercise cord 300 and a pair of handles 200 in a push-up position. Exercise cord 300 is selectively connectable to spindles 230 of handles 200. Pad 246 of second portion 242 of loop 240 and stabilizing pad 216 of shaft 210 are positioned to support handle 200 upon a surface 10 with shaft 210 oriented at an acute angle (shown in FIG. 3) with respect to the surface 10. As shown in FIG. 3, a pair of handles 200 may be grasped in each hand 5 and supported with pad 246 resting upon a surface 10 to perform a pushup. The user's hands 5 are elevated from the floor to avoid placing additional stress on the wrists. In contrast, performing pushups with hands placed directly on a floor may cause hyperextension and damage to wrists. The exercise cord 300 includes a first end 301 and a second end 305. A first section 302 is located between the first end 301 and a midpoint 303. A second section 304 is located between the midpoint 303 and the second end 305. The first end 301 may include a first connector 310, such as a carabiner, for connecting to the spindle 230 or loop 240 of a handle. 200. The second end 305 may include a second connector 320, such as a carabiner, for connecting to the spindle 230 or loop 240 of a handle 200.

Figure 7:
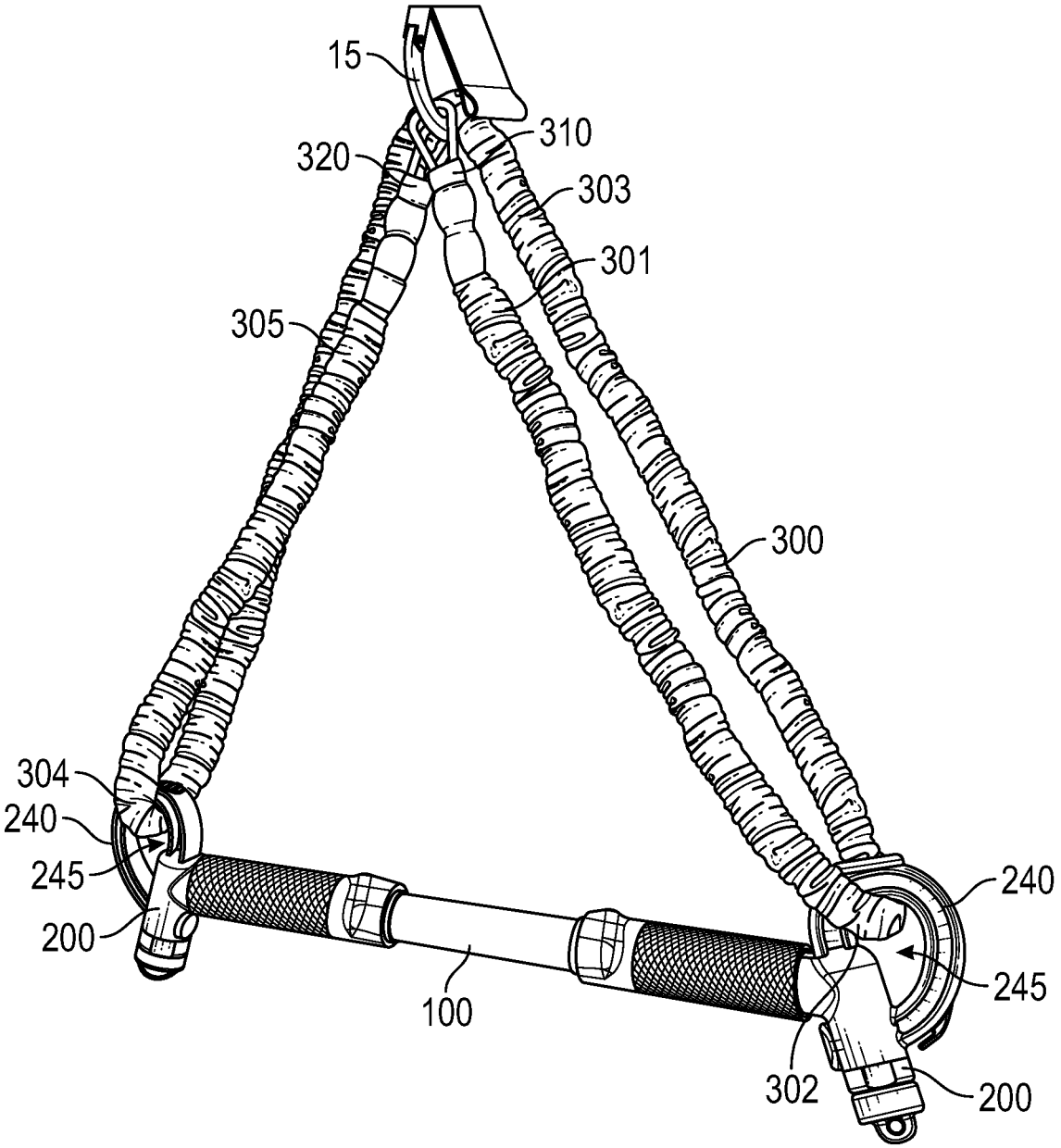
FIG. 7 shows a configuration of an exercise system with a bar, a pair of handles, and an exercise cord in an overhead dual-point position.

FIG. 7 shows a configuration of an exercise system with a bar 100, a pair of handles 200, and an exercise cord 300 in an overhead dual-point position. In a dual-point position, the bar 100 is connected to the handles 200 and each of the handles 200 is connected to an anchor point, such as ring 15, by an exercise cord 300. As shown in FIG. 7, the same exercise cord 300 may be used to connect both handles 200 to the ring 15. The resistance of the dual-point position may be increased by increasing the number of lengths of the exercise cord 300 extending between the handle 200 and the ring 15. A first level of resistance may be achieved by connecting the first connector 310 at the first end 301 to one of the handles 200, looping the exercise cord through the ring 15, and connecting the second connector 320 at the second end 305 to the other handle 200. To increase the resistance, the first end 301 is passed through the aperture 245 of the loop 240 and connected to the ring 15. Likewise, the second end 305 is passed through the aperture 245 of the other loop 240 and connected to the ring 15. As shown in FIG. 7, the midpoint 303 is positioned at the ring 15. First section 302 extends from the ring 15, through the aperture 245 of the loop 240 of the handle 200, and back to the ring 15. Second section 304 extends from the ring 15, through the aperture 245 of the loop 240 of the other handle 200, and back to the ring 15. In this manner, two lengths of exercise cord 300 extend between each of the handles 200 and the ring 15. The resistance may be further increased by, instead of connecting to the ring 15, passing the first and second ends 301, 305 through the ring 15 and back down to the respective handles 200 such that three lengths of exercise cord 300 extend between the handles and the ring 15. A longer exercise cord 300 utilized in this manner may be advantageous to reduce the number of parts needed to be transported and may reduce the need for exercise bands of differing resistances.

Figure 8:
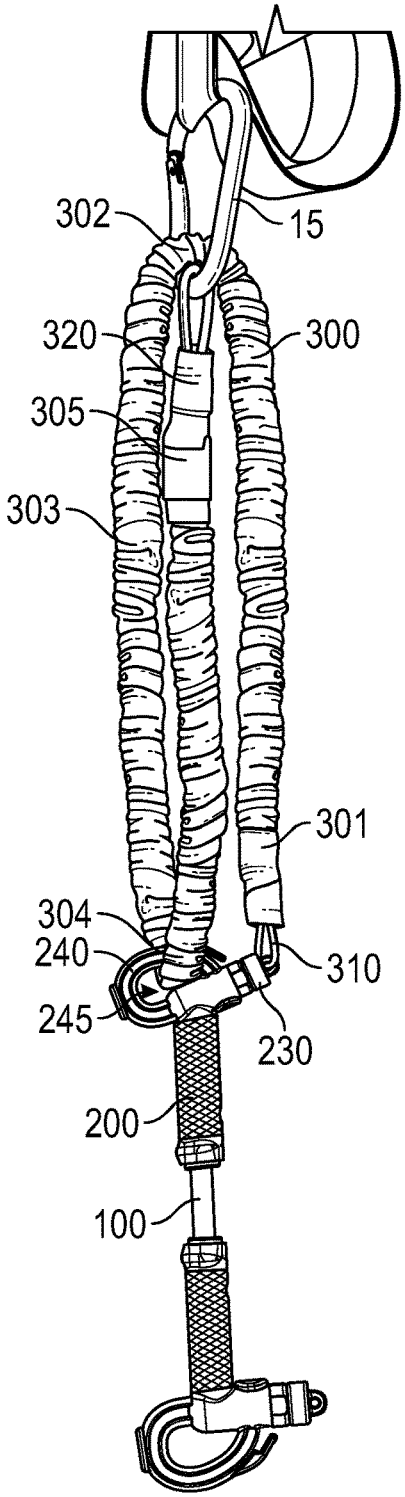
FIG. 8 shows a configuration of an exercise system with a bar, a pair of handles, and an exercise cord in an overhead single-point position.

FIG. 8 shows a configuration of an exercise system with a bar 100, a pair of handles 200, and an exercise cord 300 in an overhead single-point position. In a single-point position, the bar 100 is connected to at least one handle 200, which is connected to an anchor point, such as ring 15, by an exercise cord 300. A first level of resistance may be achieved by connecting the first connector 310 at the first end 301 to the handle 200 and connecting the second connector 320 at the second end 305 to the ring 15. The first connector 310 may be connected to the loop 240 or the spindle 230. Depending on the desired exercise, it may be desirable to connect to the loop 240 to avoid damages to the spindle 230. To increase the resistance, the first end 301 is passed through the aperture 245 of the loop 240 and connected to the ring 15. As shown in FIG. 8, the resistance may be further increased by, instead of connecting to the ring 15, passing the end 301 through the ring 15 and back down to the handle 200. In this manner, the resistance may be increased by increasing the number of lengths of the exercise cord 300 extending between the handle 200 and the ring 15.

Figure 9:
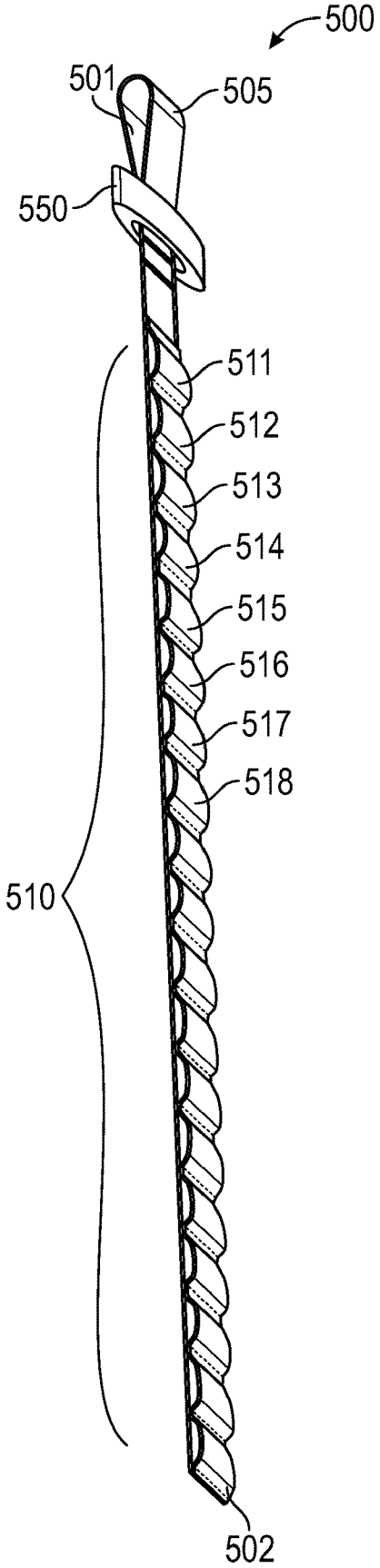
FIG. 9 shows an embodiment of a daisy chain.

FIG. 9 shows an embodiment of a daisy chain 500 and door anchor 550. The daisy chain 500 is configured to attach between a door 20 and a door jamb and provide mounting points for an exercise cord 300 (shown in FIG. 6) or rabbit runner 400. The daisy chain 500 extends from a first end 501 to a second end 502. The first end 501 is configured to be connected between a door 20 and a door jamb or to an anchor point. The daisy chain 500 includes a body 510 formed of a plurality of a loops extending towards the second end 502. The plurality of loops may include adjacent loops 511, 512, 513, 514, 515, 516, 517, 518 with loop 511 being closer to the first end 501 than loop 518. The plurality of loops may have an approximately 2" length to provide selective adjustability for a user and to facilitate connection and disconnection of a carabiner. The body 510 of the daisy chain 500 may include at least 18 loops.

In operation, a user may select a loop 511, 512, 513, 514, 515, 516, 517, 518 with the desired height for the user's height and the type of exercise being performed. The door anchor 550 is located near the first end 501 of the daisy chain 500 and may be connected to a top loop 505. In some embodiment, the door anchor 550 may be formed of folded and stitched webbing. The door anchor 500 may be integral to the daisy chain 500 and may be stitched within a loop of the daisy chain 500. Top loop 505 may have a length of approximately 4.5" or more to facilitate placement upon the door 20. In an exemplary form of operation, the body 510 of the daisy chain 500 is positioned on a first side of a door 20 and the door anchor 550 is positioned on the opposite side of the door 20. The door 20 is closed, and a user may pull against the body 510 of the daisy chain 500. The daisy chain 500 is formed of an inelastic material. The daisy chain 500 may be formed of nylon and be resistive to wear and have a high tensive strength. The daisy chain 500 may be formed from a 1.5" webbing. In some embodiment, the body 510 of a daisy chain 500 may have five or less loops, such as exactly 3 loops for connecting to a carabiner 430 (shown in FIG. 11). A shorter daisy chain 500 may be advantageous to increase portability of the exercise system.

Figure 10:
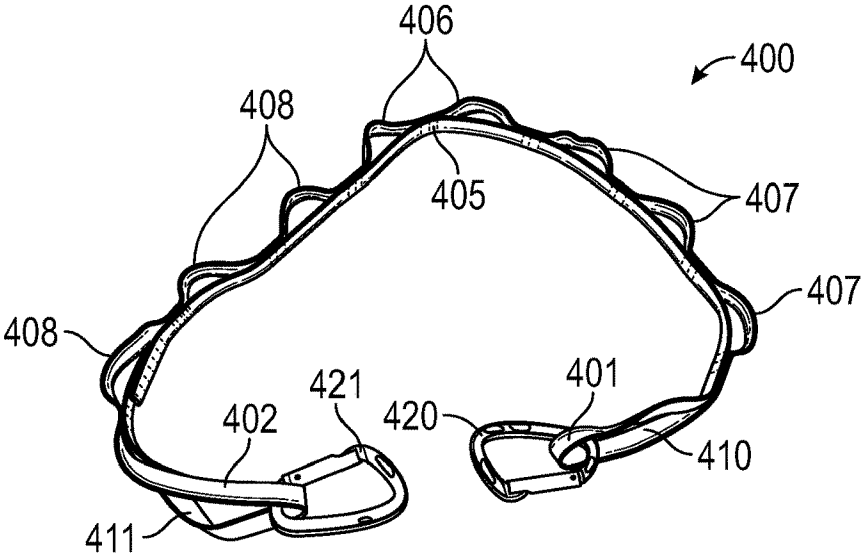
FIG. 10 shows an embodiment of a rabbit runner.

FIG. 10 shows an embodiment of a rabbit runner 400. The rabbit runner 400 is configured to attach the daisy chain 500 and to the handles 200. The rabbit runner 400 extends from a first end 401 to a second end 402. The first end 401 includes a first loop 410 and the second end 402 includes a second loop 411. The rabbit runner 400 includes a pair of center loops 406 near a midpoint 405 between the first end 401 and the second end 402. The rabbit runner 400 may include one or more mid-loops 407, such as a plurality of mid-loops 407, between the center loops 406 and the first loop 410 and include one or more mid-loops 408, such as a plurality of mid-loops 408, between the center loops 406 and the second loop 411. In some embodiments, a first carabiner 420 may be used with first loop 410 and a second carabiner 421 may be used with second loop 411. The rabbit runner 400 is formed of an inelastic material. The rabbit runner 400 may be formed of nylon and be resistive to wear and have a high tensive strength. The rabbit runner 400 may be formed of a 0.75" to 1.5" webbing.

Figure 11:
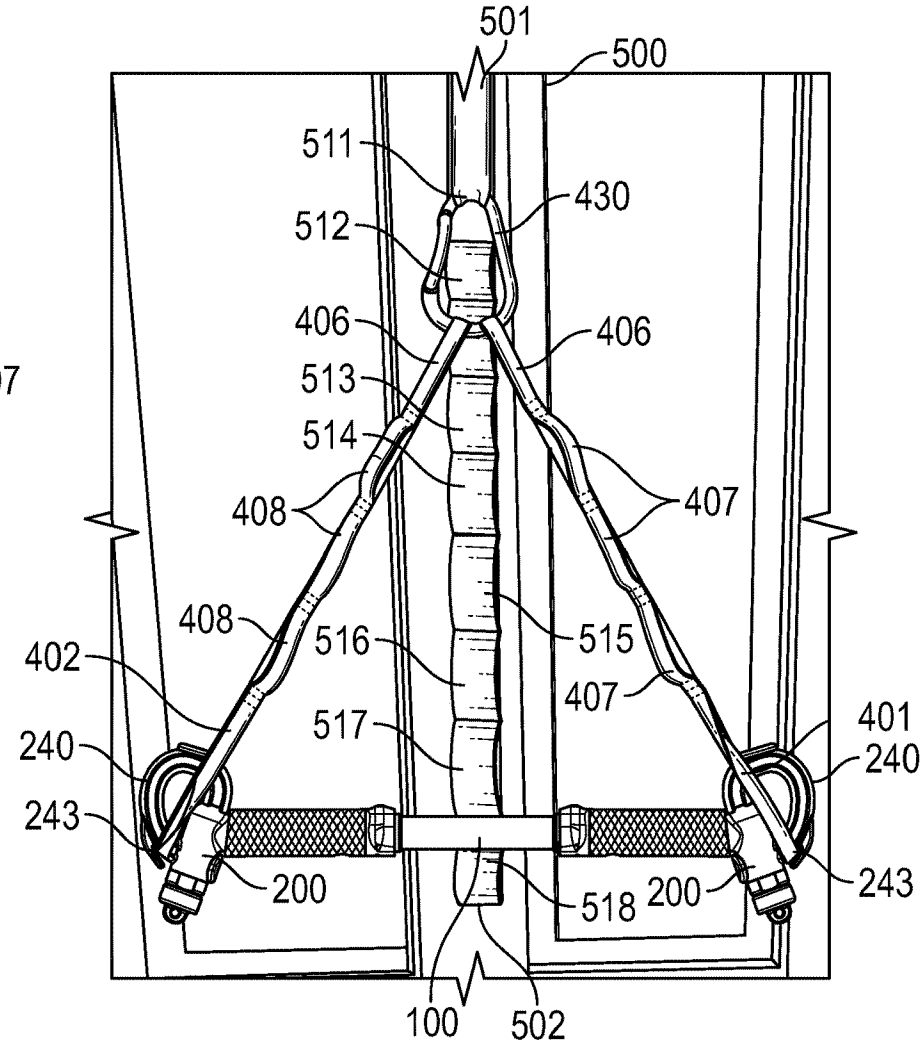
FIG. 11 shows a configuration of an exercise system having a daisy chain, rabbit runner, bar, and a pair of handles.

FIG. 11 shows a configuration of an exercise system having a daisy chain 500, a rabbit runner 400, a bar 100, and a pair of handles 200. Bar 100 is connected to the handles 200 and each of the handles 200 are connected to the rabbit runner 400. The rabbit runner 400 is connected to the daisy chain 500 via a carabiner 430 extending through one of the plurality of loops of the daisy chain, such as loop 511, and through both of center loops 406. The two center loops 406 increases strength of the connection and provides for two points of contact on a carabiner 430 to accommodate syncopated resonance training with the bar 100. The first loop 410 and the second loop 411 may have a large enough diameter to fit over the loop 240 of the handle 200 to be secured by notch 243. If a user desires to lessen the distance between the bar 100 (and handles 200) and the point of articulation (connection with carabiner 430), the carabiner 430 may be connected through two of the mid-loops 407, 408. If a user desires to raise or lower the point of articulation (connection with carabiner 430), the carabiner 430 may be connected through any of loops 511, 512, 513, 514, 515, 516, 517, 518 of the daisy chain 500.

Figure 12:
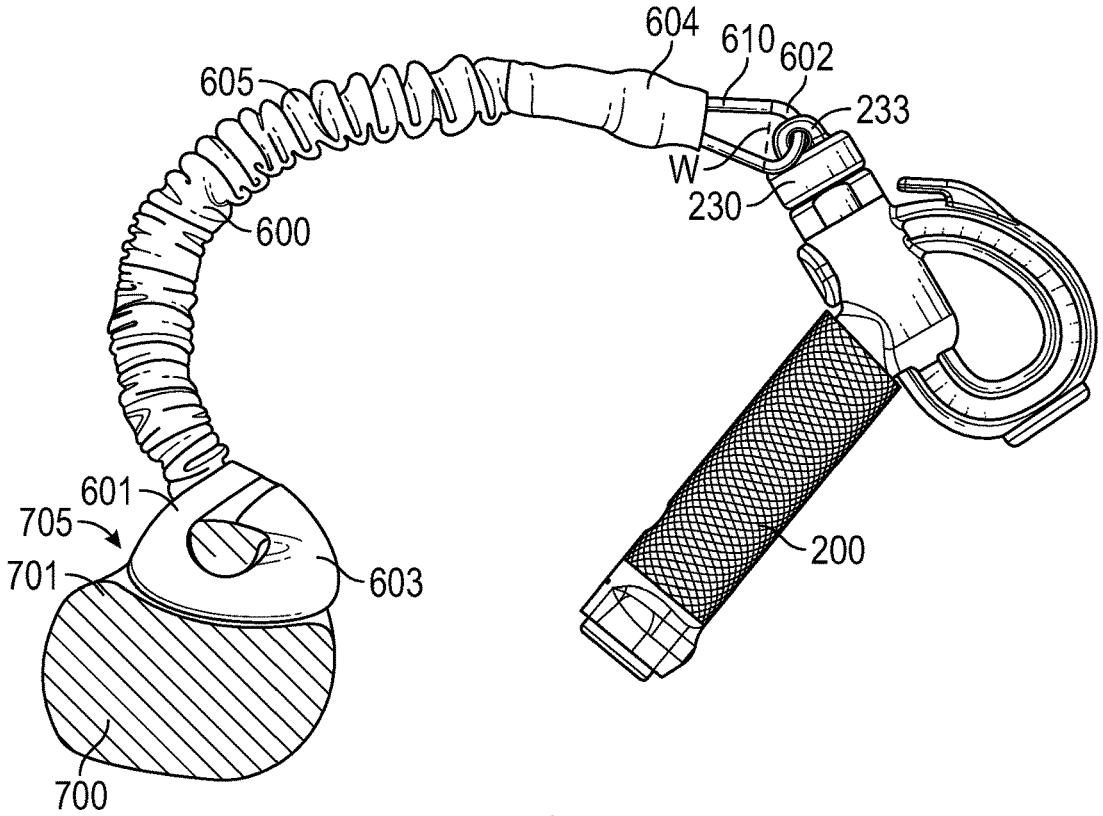
FIG. 12 shows a configuration of an exercise system with a handle and an exercise cord with a weighted mass.

FIG. 12 shows a configuration of an exercise system with a handle 200 and an exercise cord 600 connected to a weighted mass. The exercise cord 600 includes a body extending from a first end 601 to a second end 602. The first end 601 is configured to connect to a weighted mass, such as a kettleball 700 (shown in cross-sectional view). The first end 601 may include a loop 603. The kettleball 700 includes a body 701 and a passageway 705 extending through the body 701. The exercise cord 600 is wrapped upon itself by passing the first end 601 through the passageway 705 of the kettleball 700 and the body 605 back through the loop 603 to secure the kettleball 700 to the exercise cord 600. The second end 602 is connected to the ring 233 of the spindle 230 of the handle 200. The second end 602 may include a carabiner 610 to connect to ring 233. The carabiner 610 may be integral to the exercise cord 600. In some embodiments, exercise cord 600 may include a sleeve 604, such as a rubber sleeve, that at least partially covers the connection with the spindle 230. A sleeve 604 may be advantageous to inhibit direct contact between a user's hand and the connection.

Figure 13:
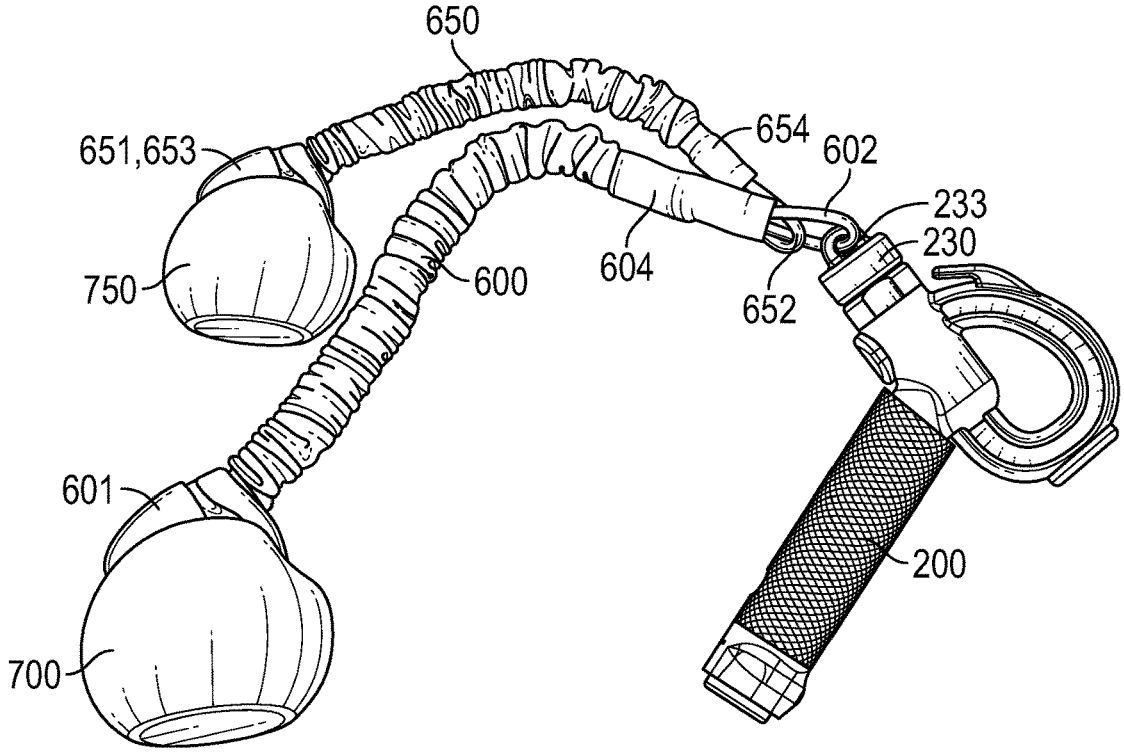
FIG. 13 shows a configuration of an exercise system with a handle, a pair of exercise cords with weighted masses.

FIG. 13 shows a configuration of an exercise system with a handle 200, an exercise cord 600 connected to a kettleball 700, and a second exercise cord 650 connected to a second kettleball 750. The second exercise cord 650 includes a body extending from a first end 651 to a second end 652. The first end 651 may include a loop 653. The second end 652 is connected to the ring 233 of the spindle 230 of the handle 200. The second end 652 may include a carabiner to connect to ring 233 or a carabiner. The carabiner may be integral to the exercise cord 650. In some embodiments, exercise cord 650 may include a sleeve 654, such as a rubber sleeve, that at least partially covers the connection within the spindle 230. A sleeve 654 may be advantageous to inhibit direct contact between a user's hand 5 and the connection.

Exercise cords 600, 650 may be interchangeable or used together to increase resistance. Exercise cords 600, 650 may be of different lengths and/or resistances. The interchangeable exercise cords 600, 650 of varying resistance and length may allow users to vary the training load applied to the skeletal, muscular, nervous, and cardiovascular systems of the body. A one-foot to two-foot exercise cord may be utilized for spinning the kettleballs 700, 750. A four to nine-foot exercise cord may be used for light, medium, and high-tension muscle strengthening exercises, as well as jumping, pulling, and medium/high-tension resonating exercises to improve stamina. A six to nine-foot exercise cord may be particularly advantageous for looping the exercise cord to increase resistance, as would be appreciated by one of skill in the art having the benefit of this disclosure. Kettleballs 700, 750 may be of different sizes and/or weights. The interchangeable kettleballs 700, 750 of varying weight and size may allow users to vary the training load applied to the skeletal, muscular, nervous, and cardiovascular systems of the body. The kettleballs 700, 750 are sized sufficiently larger than a typical orbital socket of a user to avoid inadvertent injury to an eye during use. The kettleballs 700, 750 may have a diameter of 2.5 inches or greater.

Figure 14:
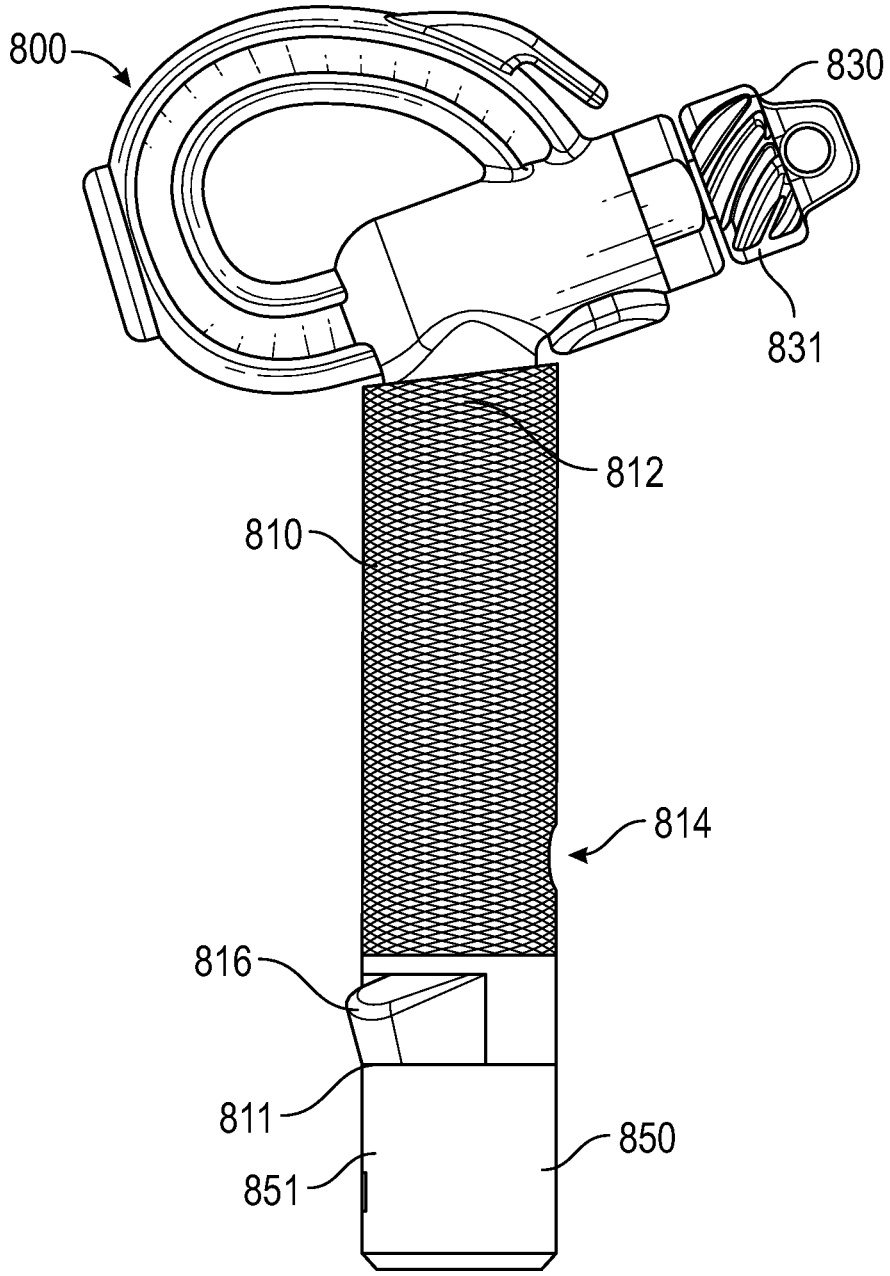
FIG. 14 shows an embodiment of a handle and a connectable weight.

FIG. 14 shows another embodiment of a handle 800. Handle 800 is similar to handle 200 but includes a shaft 810 configured to selectively receive a weight. Shaft 810 may be hollow, and the weight may be received and retained completely within the shaft 810. In some embodiments, shaft 810 includes a first end 811 and a second end 812 with a length extending along an axis 815 from first end 811 to second end 812. A hole 814 extends through a sidewall of the shaft 810. The first end 811 is configured to connect to a removeable weight 850. Weight 850 may be oriented below a stabilizing pad 816. Weight 850 may be interchangeable of different magnitudes, such as part of a 1-pound, 2-pound, and 3-pound set. Weight 850 may include a body 851 having a cross-sectional area substantially similar to the shaft 810 and may be used as an extension of shaft 810 to accommodate larger hands. Body 851 may have a length of less than two inches in some embodiments. During exercises, the additional mass on the bottom of the handle 800 may be utilized to increase an overload on the body. Handle 800 may include a spindle 830. Spindle 830 may be used in place of spindle 230. Spindle 830 may include grooves 831. The grooves 831 may be beneficial to reduce weight of the spindle 230. Spindle 830 may be 160 grams or less.

Figure 15:
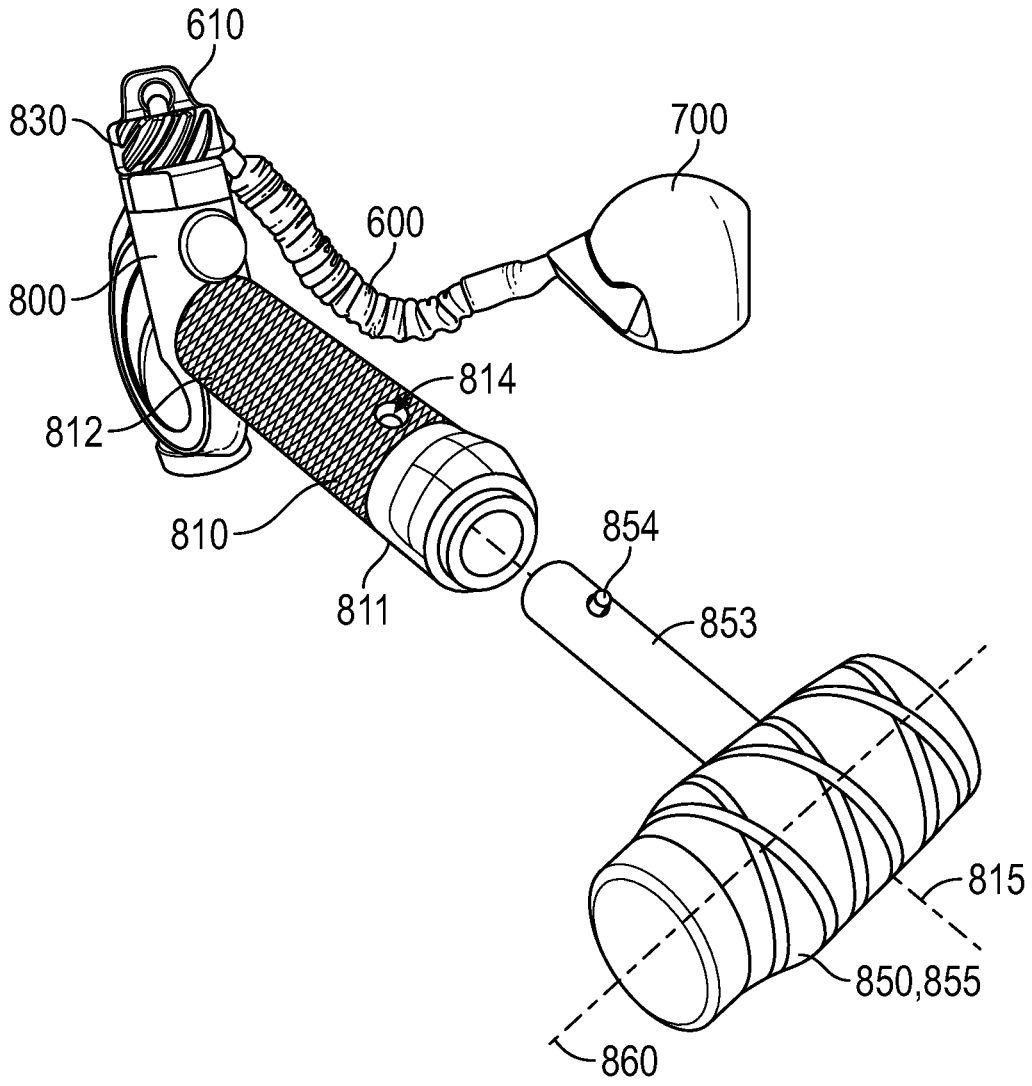
FIG. 15 shows a partially disassembled view of an embodiment of a handle and a connectable weight.

FIG. 15 shows an embodiment of a weight 850 temporarily disconnected from first end 811 of shaft 810 of handle 800. In addition to or in place of body 851 may be an elongated body 855 having a length extending along an axis 860. Axis 860 of elongated body 855 is not parallel to axis 815 of shaft 810 and may be perpendicular to axis 815. Weight 850 may include a protrusion 853 with a spring-loaded button 854 operable to be received within shaft 810 and engage hole 814 in shaft 810 to retain weight 850 with shaft 810. Elongated body 855 may be positioned with its length along a surface 10 to facilitate a push up position of handle 800 and provide a widen stabilizing stance.

Figure 16:
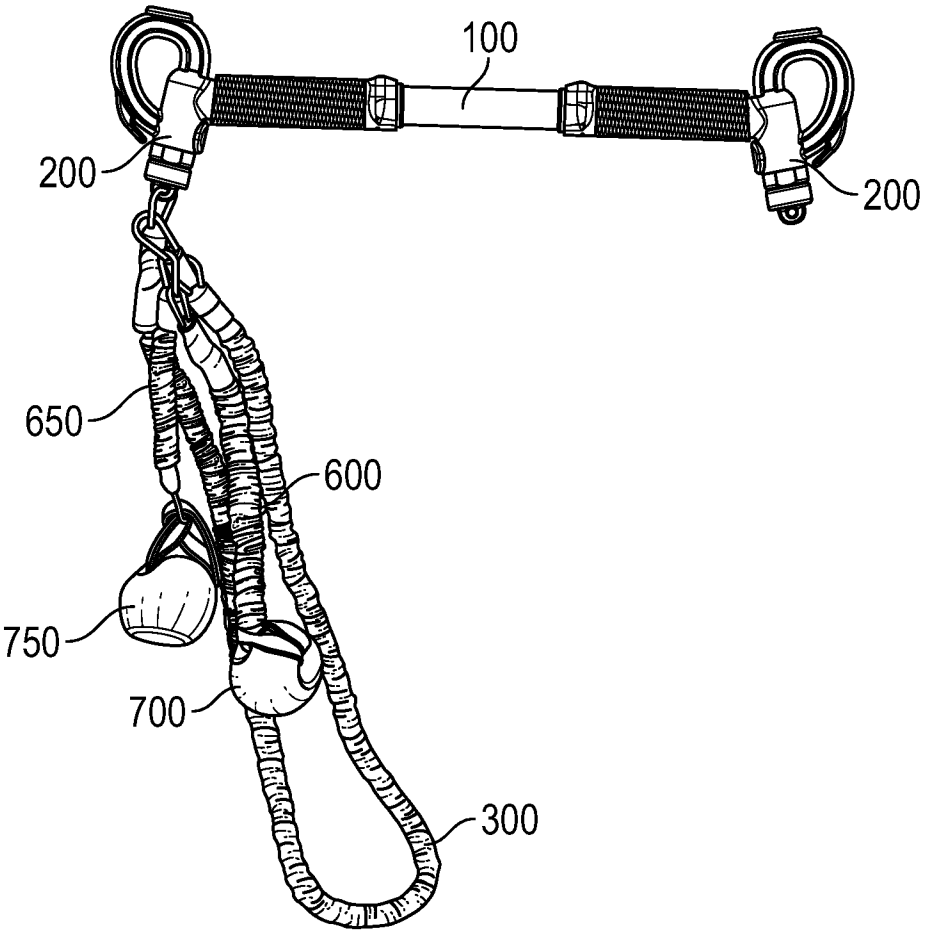
FIG. 16 shows a configuration of an exercise system with a bar, a pair of handles, a pair of exercise cords, a pair of weighted masses, and a long exercise cord.

FIG. 16 shows an embodiment of an exercise system with a bar 100, a pair of handles 200, a pair of exercise cords 600, 650, a pair of kettleballs 700, 750, and a long exercise cord 300. The three sets of exercise cords 300, 600, 650 may be connected to a loop 240 of one handle 200. This configuration may be particular advantageous for "slamming" exercises where force is directed into the ground.

The embodiments described herein permit the performance of physical exercises for a variety of muscle groups. The embodiments described herein may also provide for a portable system that may be easily transported with a user for use in various locations, such as a hotel room or outdoors. Embodiments of methods utilizing these exercise systems are described herein. Some embodiments of exercise systems may include published instructions, such as diagrams or instructions videos, on how to assemble the exercise systems and perform these exercises.

One exemplary exercise is shown in FIG. 6. A user grasps the shaft 210 of a handle 200 in each hand 5 with the elastically deformable pad 246 and stabilizing pad 216 resting upon a surface 10. The user's fingers are elevated from the surface 10 and the wrists are not hyperextended while the user performs a pushup. In some embodiments, push-ups can be performed with the spindle 230 facing down and in contact with the surface 10. The handle 200 is more stable and secure when the elastically deformable pad 246 and stabilizing pad 216 are resting upon the surface 10.

Figure 17:
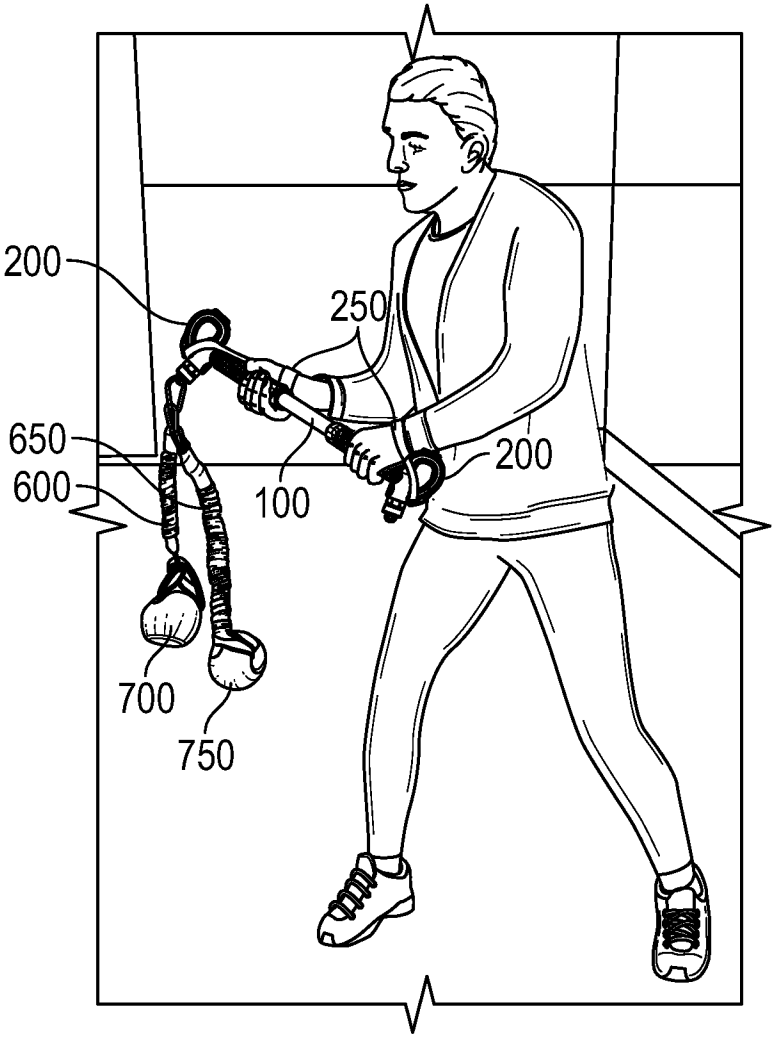
FIGS. 17-41 illustrate exemplary exercises conducted with embodiments of exercise systems.

FIGS. 17-41 illustrate further exemplary exercises conducted with various configurations of exercise systems. The exemplary exercises shown in FIG. 17 utilize the configuration shown in FIG. 16. The exercise system is assembled by attaching both handles 200 to bar 100. In some embodiments, exercise cord 600 and kettleball 700 is attached to the spindle 230 (shown in FIG. 3). In some embodiments, exercise cord 650 and kettleball 750 is also attached to spindle 230, directly or by connection to exercise cord 600. In still further embodiments, exercise cord 300 may also be attached to spindle 230. Kettleball 700 connected to an exercise cord 600 can rotate slowly or rapidly in a variety of movement patterns by movement of weight bar 100. Movement of bar 100 may result in a greater overload of core-musculature due to the increased mass and extended length of bar 100. With a handle 200 attached to one or both ends of bar 100, a user may perform multi-directional throwing, paddling, chopping and spinning multi-dimensional movement patterns against a variety of resistance levels. A user's hands may be about shoulder width apart with a staggered stance. Kettleball 700 is rotated on the user's left side and then moved across the user's body by rotating the trunk of the body. Kettleball 700 is then rotated on the user's right side. Kettleball 700 may be passed side-to-side in a FIG. 8 pattern.

For some exercises, exercise cord 600, exercise cord 650, and/or exercise cord 300 may be connected to loop 240 such that they do not rotate. The other ends of exercise cord 600, exercise cord 650, and/or exercise cord 300 may also be attached to spindle 230. This configuration may be used for throwing, slamming and circular patterns.

Figure 19:
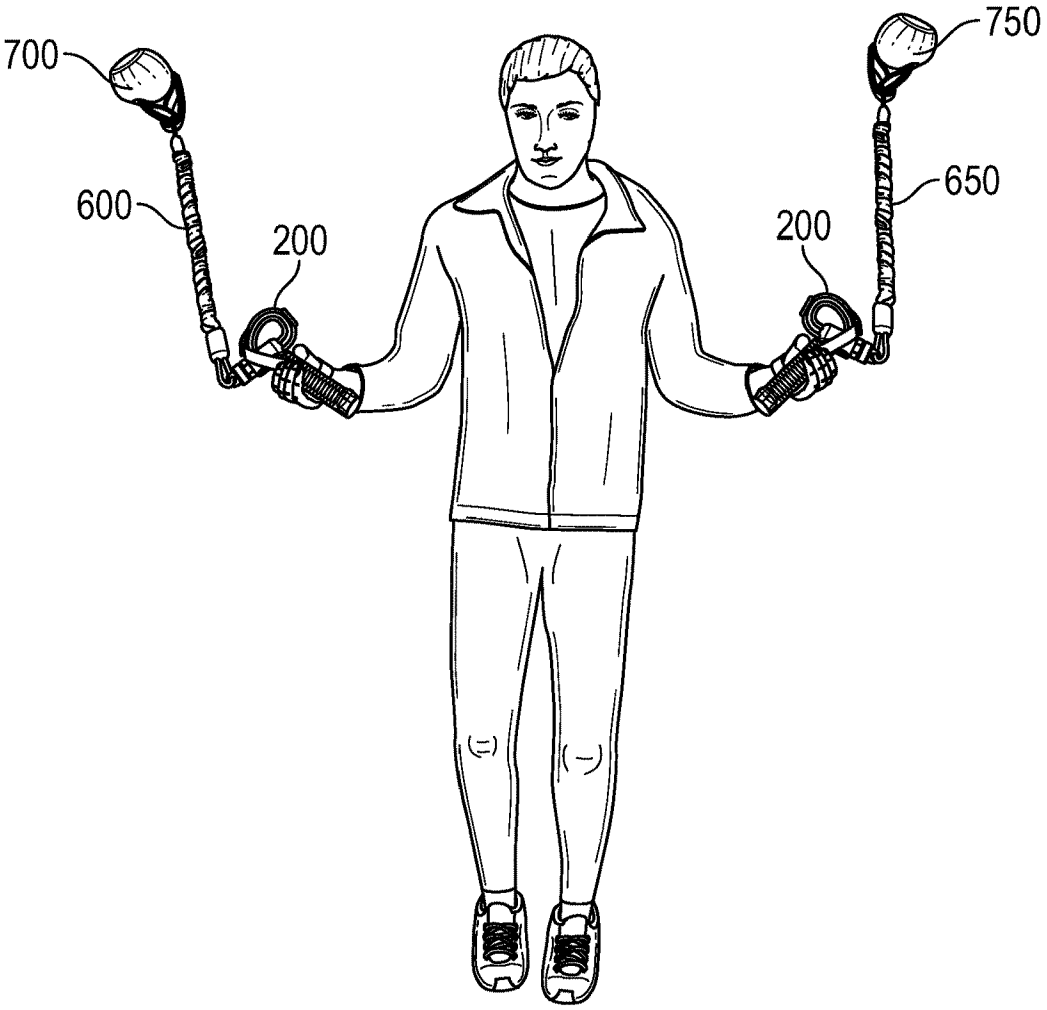
Figure 18:
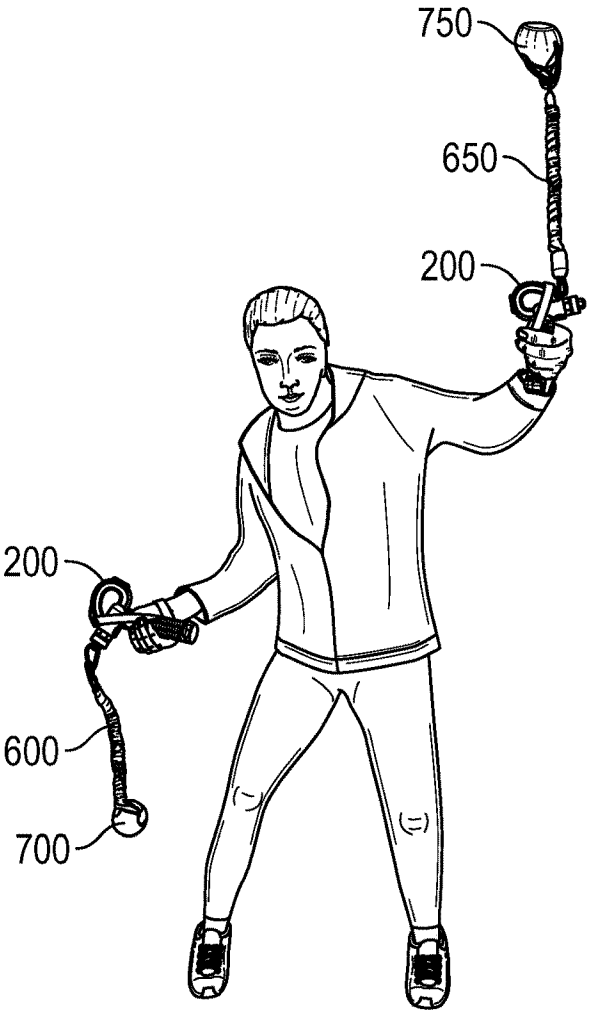
Figure 20:
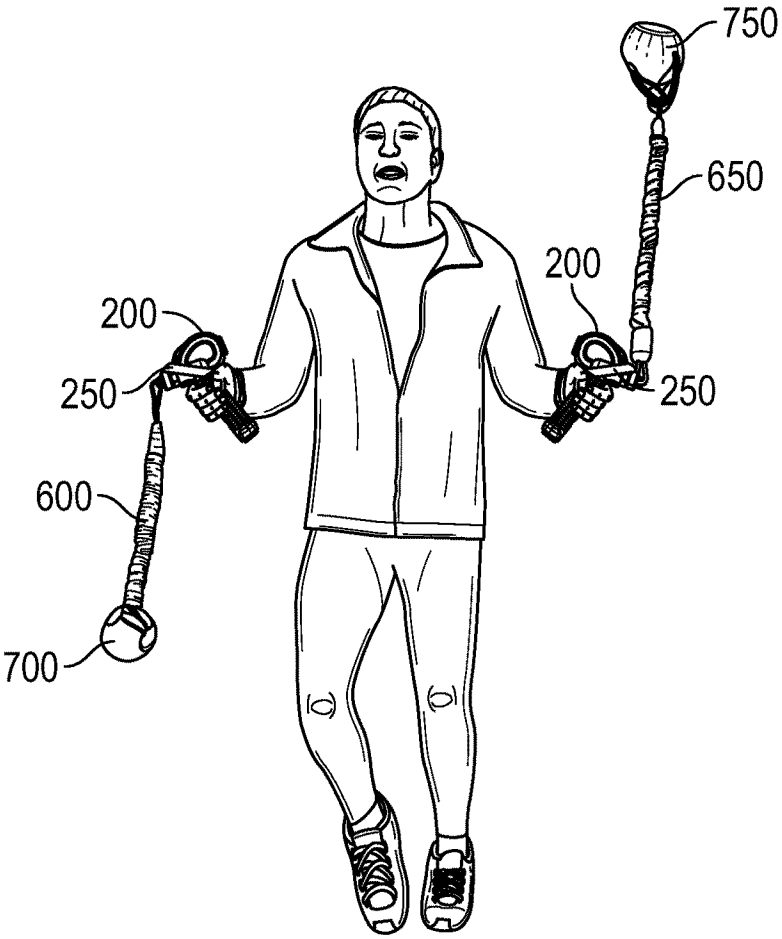

The exemplary exercises shown in FIGS. 18-20 utilize the configuration shown in FIG. 12. With a handle 200 attached to an exercise cord 600 and kettleball 700, a user may perform multi-directional chopping and spinning multi-dimensional movement patterns against a variety of resistance levels. The user may hold a handle 200 in each hand 5. The first handle 200 may include exercise cord 600 and kettleball 700. The second handle 200 may include exercise cord 650 and 750. A variety of patterns can be performed in various hand-positions with both kettleballs 700, 750 traveling downward front, or upward front, or one ball traveling upward front while the other goes downward front, or vice versa. As shown in FIG. 18, kettleball 700 and kettleball 750 may be rotated in the same direction, out-of-phase to form a syncopated pattern. As shown in FIG. 19, kettleball 700 and kettleball 750 may be rotated in the same direction, in-phase to form a symmetrical pattern. A user swings their hands and arms downward, which make the kettleballs 700, 750 accelerate down at the same time the hips and knees are dropping down, to increase ground reactive force. Subsequently, the hands, arms and kettleballs 700, 750 accelerate upward at the same moment the hips and user's center of mass are accelerated upward. As shown in FIG. 20, the use of a handle 200 in each hand 5 simultaneously permits for a multitude of alternating/resonating patterns where the centrifugal force of the kettleballs 700, 750 is in an alternating oscillation pattern as opposed to a symmetrical pattern. The alternating oscillation pattern facilitates functional resonance of the body's muscles and oblique fascial slings which creates ameliorative adaptations for locomotion and sports performance.

The exemplary exercises shown in FIGS. 21-23C utilize the configuration shown in FIG. 13. Shaft 210 (best seen in FIG. 3) may be sized to receive two hands and increases functional adaptations transferable to sports and life. A two-handed grip configuration can be used to perform many exercises which facilitate mobility and functional resonance in the thoracic and lumbar spine. A two-handed grip configuration may enable the user to use a heavier exercise cord 600 and heavier kettleball 700, resulting in higher levels of centrifugal force to the kettleball 700 and thereby load the body's muscles, bones, and fascia with higher levels of centripetal force to manage and resist. Likewise, a second exercise cord 650 and kettleball 750 may also be used. By using two hands and a heavier resistance exercise cord attached to a heavier kettleball and/or a second exercise cord and kettleball, the exerciser can achieve a greater overload to the lower body, core, and upper body musculature. More force can also be generated by increasing the rotational speed of the kettleball.

Figure 21:
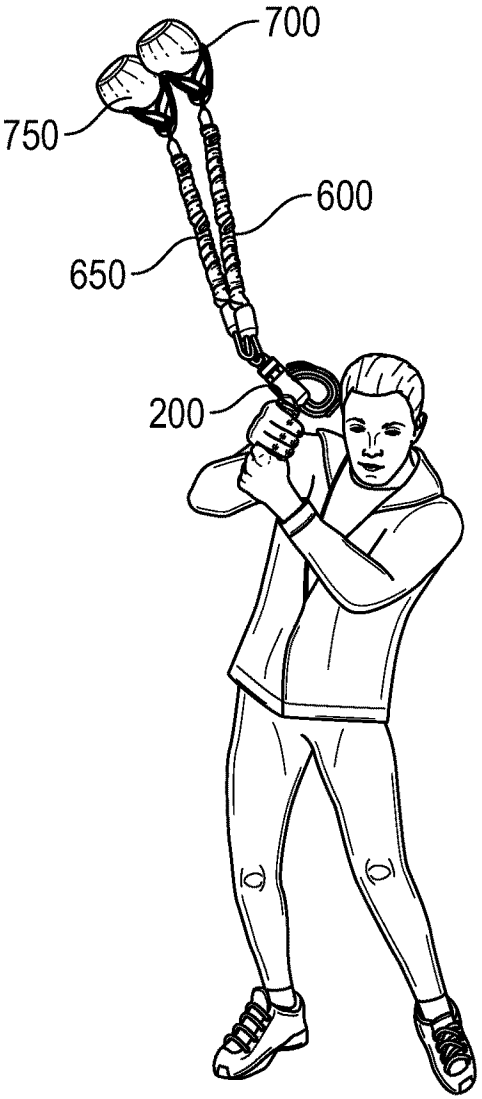
Figure 22:
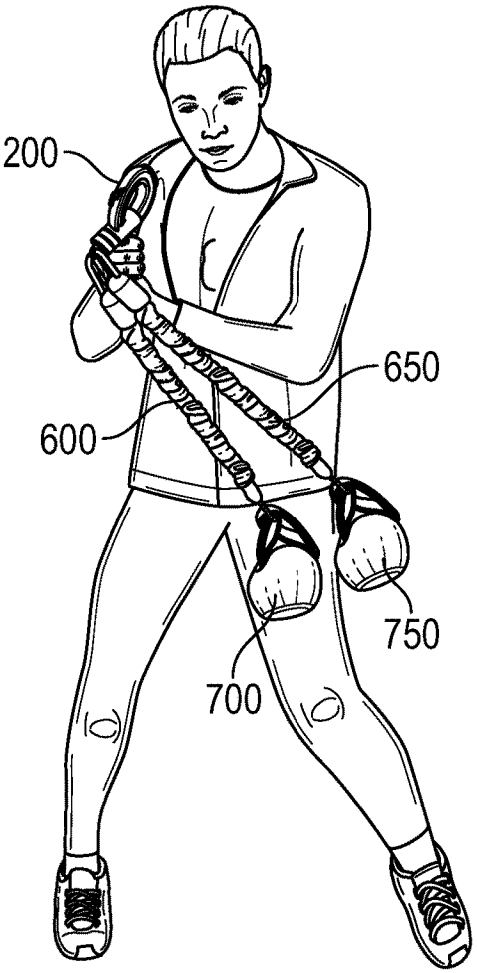

As shown in FIG. 21, performing FIG. 8 chopping patterns—either upward or downward—creates a harmonic resonance wherein the active (muscles) and passive (fascia) movement and stabilization systems of the body interact harmonically and thereby resonate with the elastic and kinetic energy of the exercise cord 300 and swinging kettleball 700. Humans employ this axial rotational resonance instinctively when we walk, run, and perform other rhythmical activities such as swimming, cycling, and Nordic skiing. Aging adults tend to become more sedentary and progressively lose the mobility and ability to functionally resonate which can adversely affect walking, running, and performing three dimensional tasks. As shown in FIG. 22, rotation of the kettleballs 700, 750 may be conducted in a plane in front of the user. During an exercise routine, a user may translation between the different uses shown in FIGS. 21-23C.

Figure 23A:
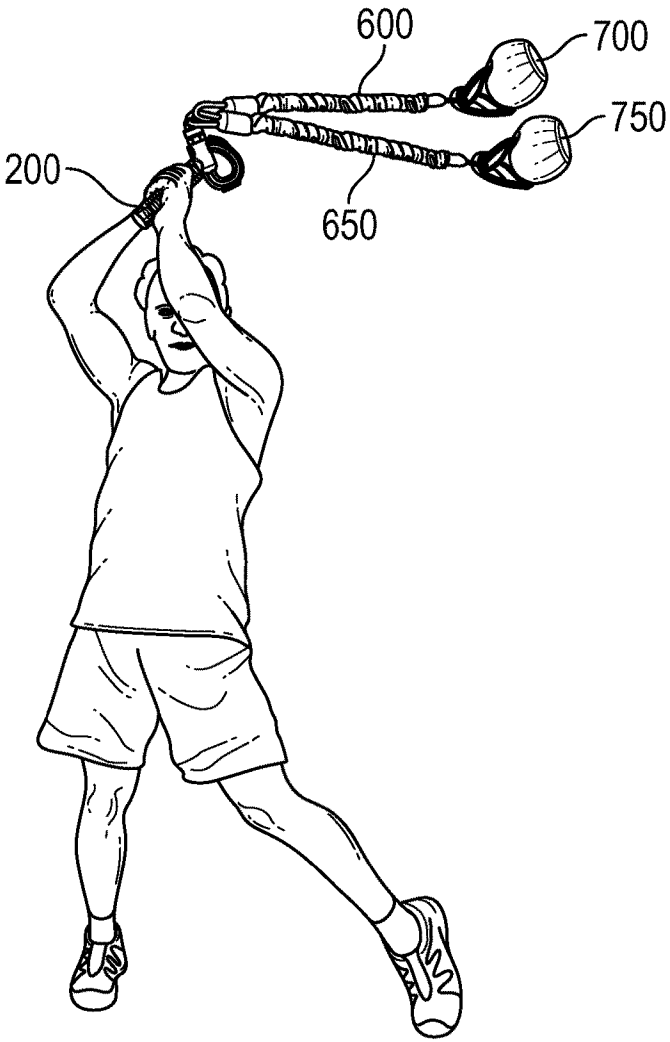
Figure 23C:
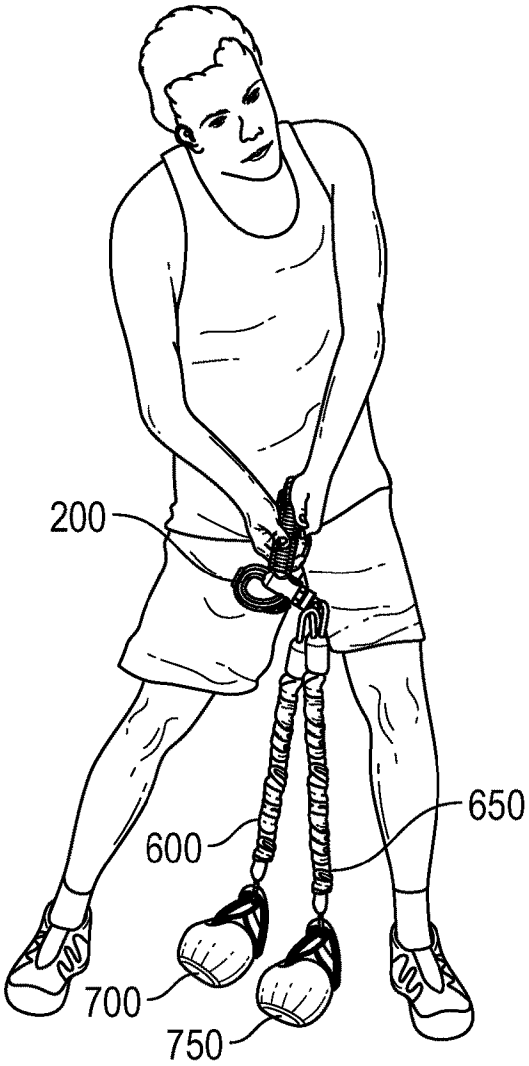
Figure 23B:
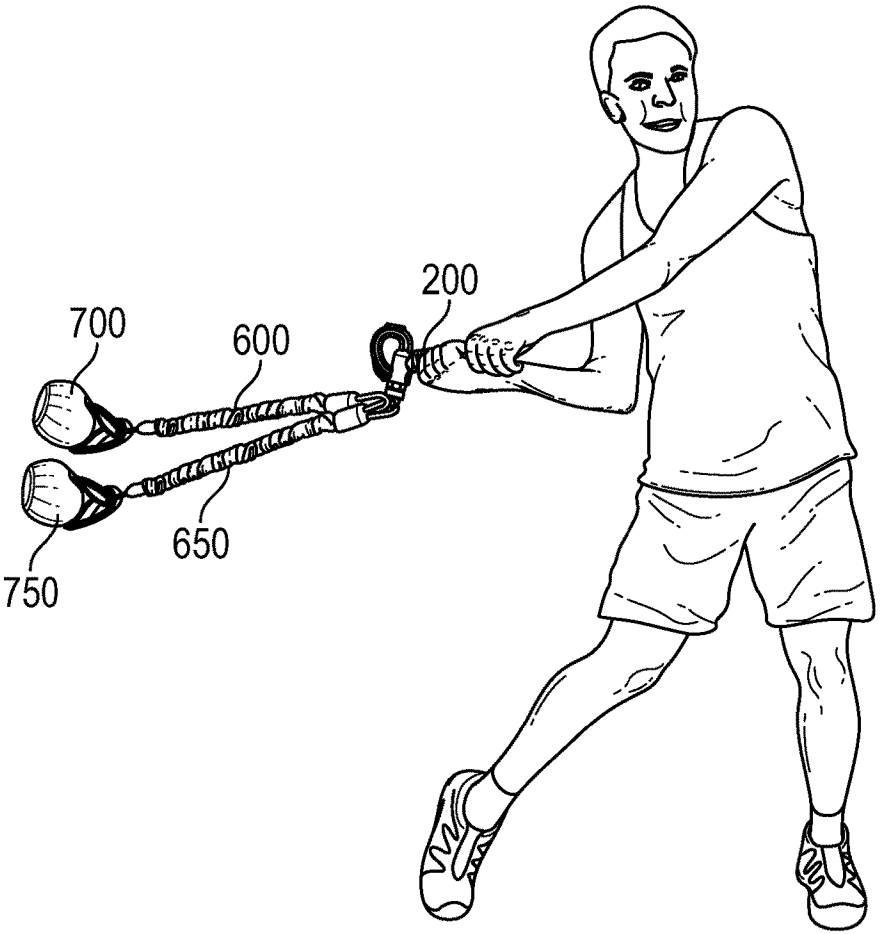

As shown in FIG. 23A, rotation of the kettleballs 700, 750 may be conducted in a plane above the user's head. A user may alternate weight between their feet as they rotate the kettleballs 700, 750 within the plane. The user may twist and drop the kettleballs 700, 750 into a plane around their torso to simulate swinging a bat, as shown in FIG. 23B. The user may twist and drop the kettleballs 700, 750 into a plane below their knees to simulate swinging a club, as shown in FIG. 23C. A user may alternate the plane in which the kettleballs 700. 750 are being rotated.

Figure 24B:
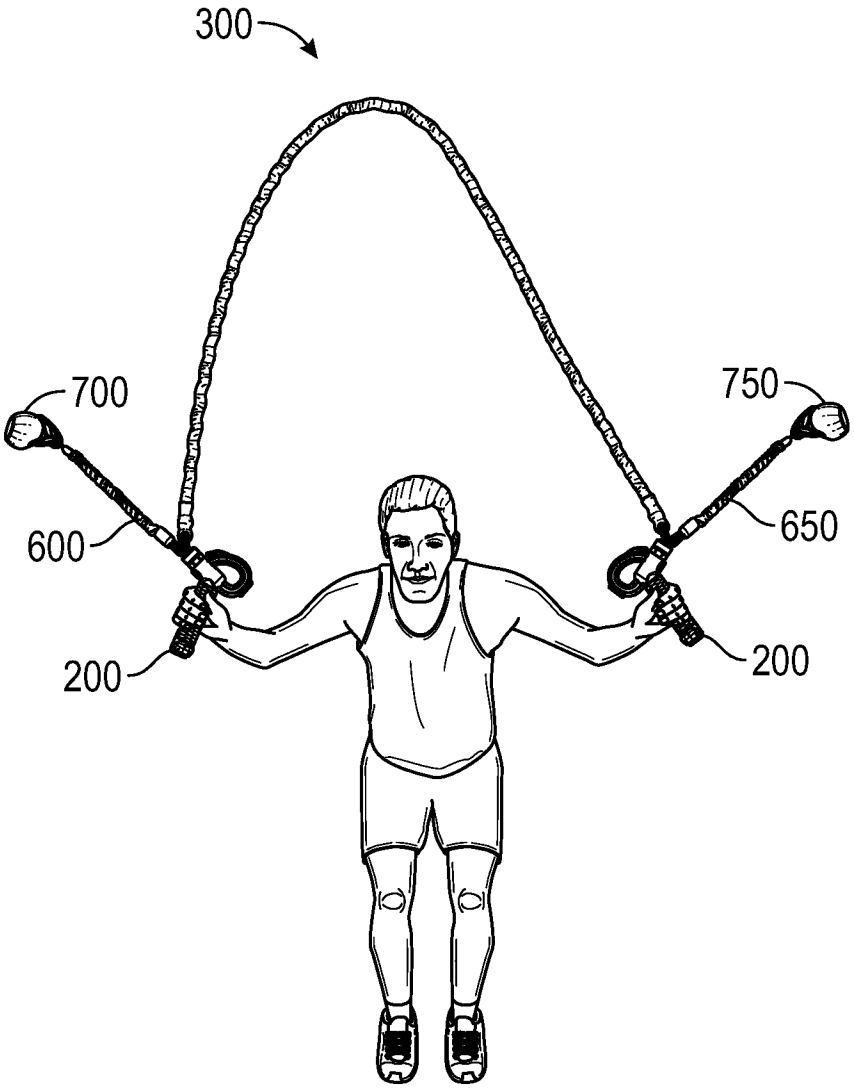
Figure 24A:
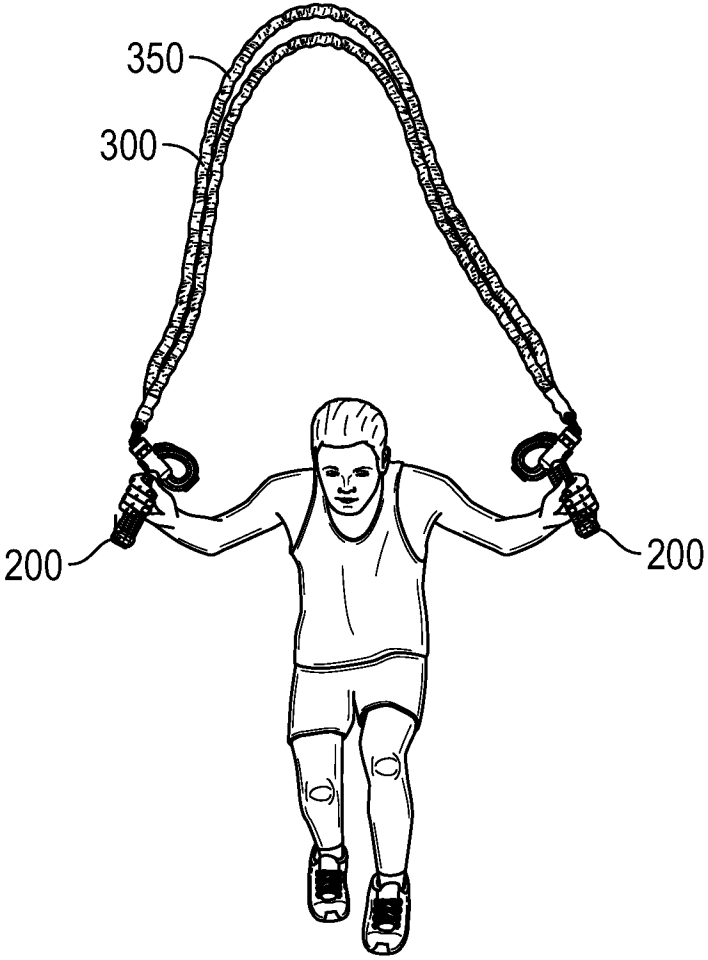
Figure 24C:
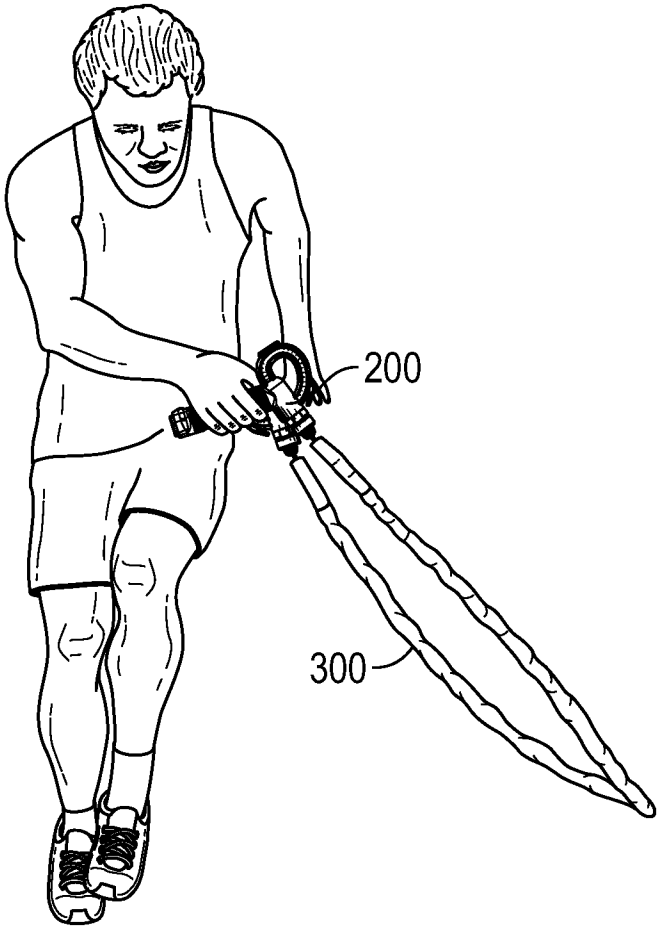

The exemplary exercises shown in FIGS. 24A-C and 25A-C utilize the configuration shown in FIG. 6. A long exercise cord 300 is attached at each end to a spindle 230 (shown in FIG. 3) of a handle 200. As shown in FIG. 24A-C, this configuration may be used in place of a known jump rope. The weight and length of the exercise cord 300 increase the ground force and increases the overload on the user. As shown in FIG. 24A, one or more additional exercise cords 350 can be used to increase the overload. For instance, the one or more additional exercise cords 350 can be attached to connectors 310, 320, such as carabiners, at the ends of the primary exercise cord 300 (shown in FIG. 6) rather than directly to the handle 200. As shown in FIG. 24B, exercise cord 600 and kettleball 700 may be attached to the spindle 230 of a first handle 200 and exercise cord 650 and kettleball 750 may be attached to the spindle 230 of a second handle 200. Exercise cords 600, 650 can be attached to connectors 310, 320, such as carabiners, at the ends of the primary exercise cord 300 (shown in FIG. 6). During exercise, the user rotates the kettleballs 700, 750 in a circular motion as the long exercise cord 300 is jumped over. As shown in FIG. 24C, the long exercise cord 300 may be moved side-to-side in an alternating motion or in a circular motion to be jumped over.

Figure 25A:
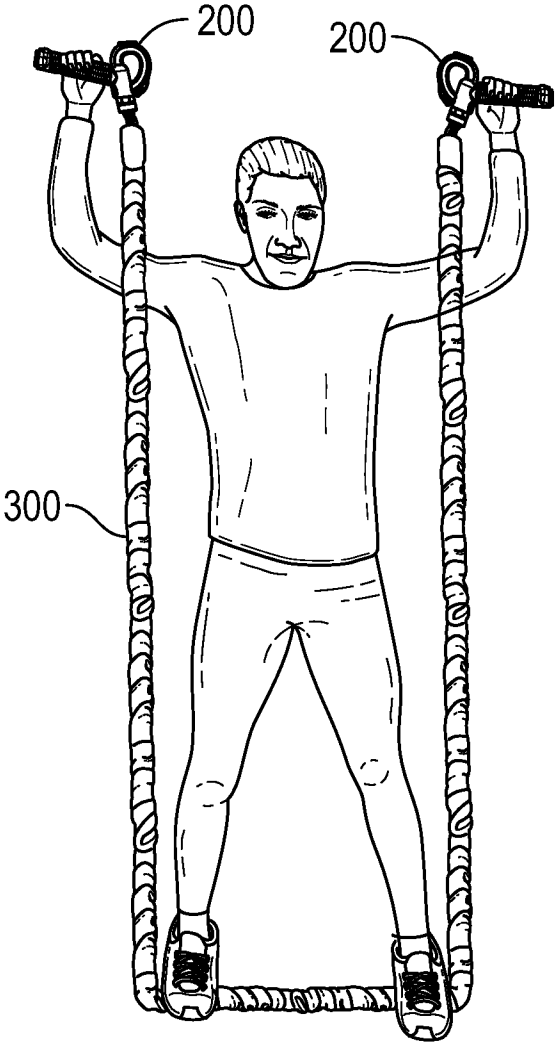
Figure 25C:
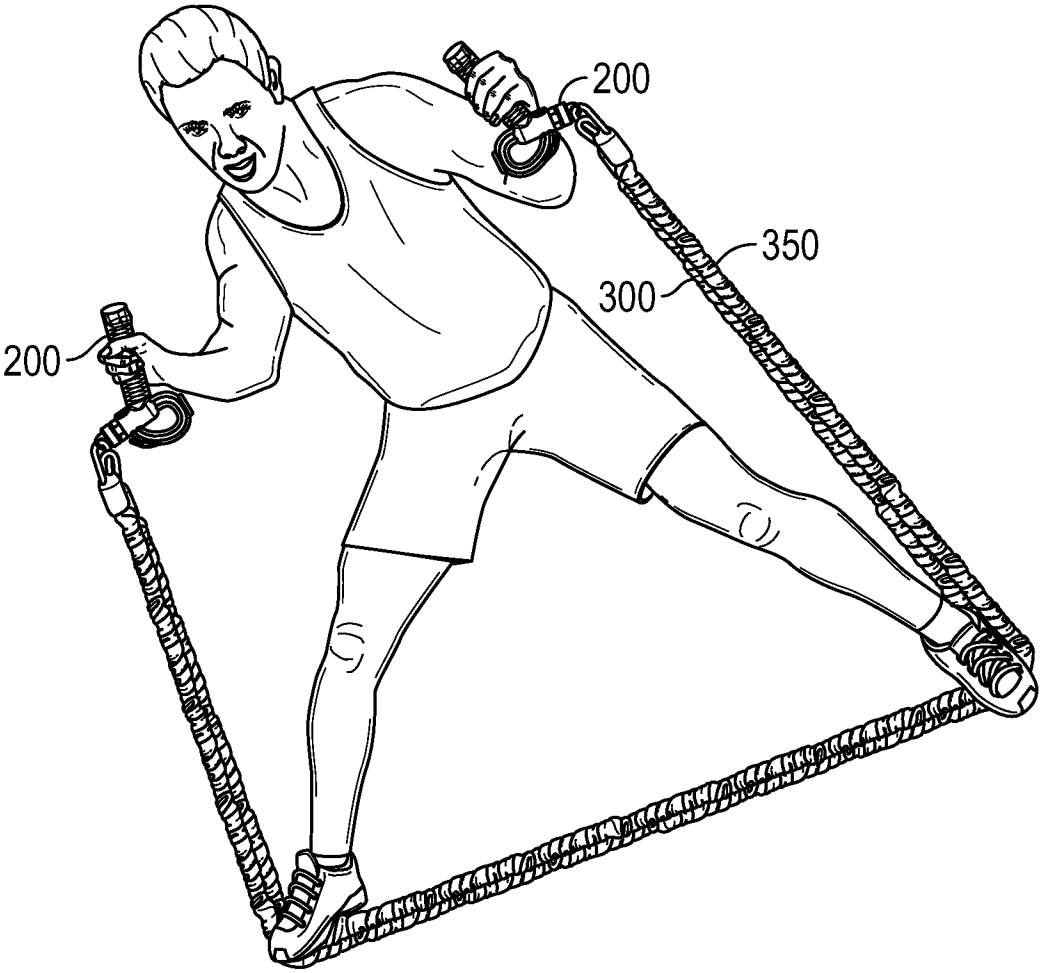
Figure 25B:
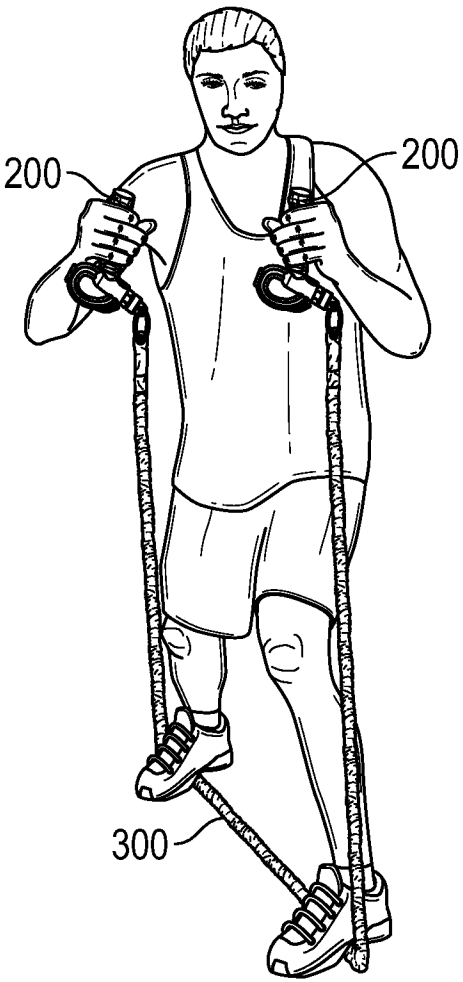

FIGS. 25A-C illustrate exercises where a user stands upon a long exercise cord 300 and extends against the resistance. As shown in FIG. 25A, a user may stand upon the exercise cord 300 and extend handles 200 outward and upward against the resistance of exercise cord 300. A user may also stand on the exercise cord 300 with only one foot and pull in a side lunge position. As shown in FIG. 25B, a user may stand upon the exercise cord 300 and extend handles 200 outward and forward in a jabbing motion. The user may grasp the handles 200 with the connection point with the exercise cord 300 in a downward orientation such that resistance of exercise cord 300 is directed downward directly below the hands. As shown in FIG. 25C, a user may stand upon the exercise cord 300 with both feet and transfer weight between feet while raising the opposing leg. The user may also extend their leg outward in a kicking motion. In some embodiments, the handles 200 may be connected to a bar 100 (shown in FIGS. 1-2) and may push or pull against the bar 100. For example, a user may place the exercise cord 300 and push upward on the bar 100 with one hand while performing a forward squat. The user may grasp the loops 240 (best shown in FIG. 3) to maintain a uniform upper body hold while performing exercises.

Figure 27:
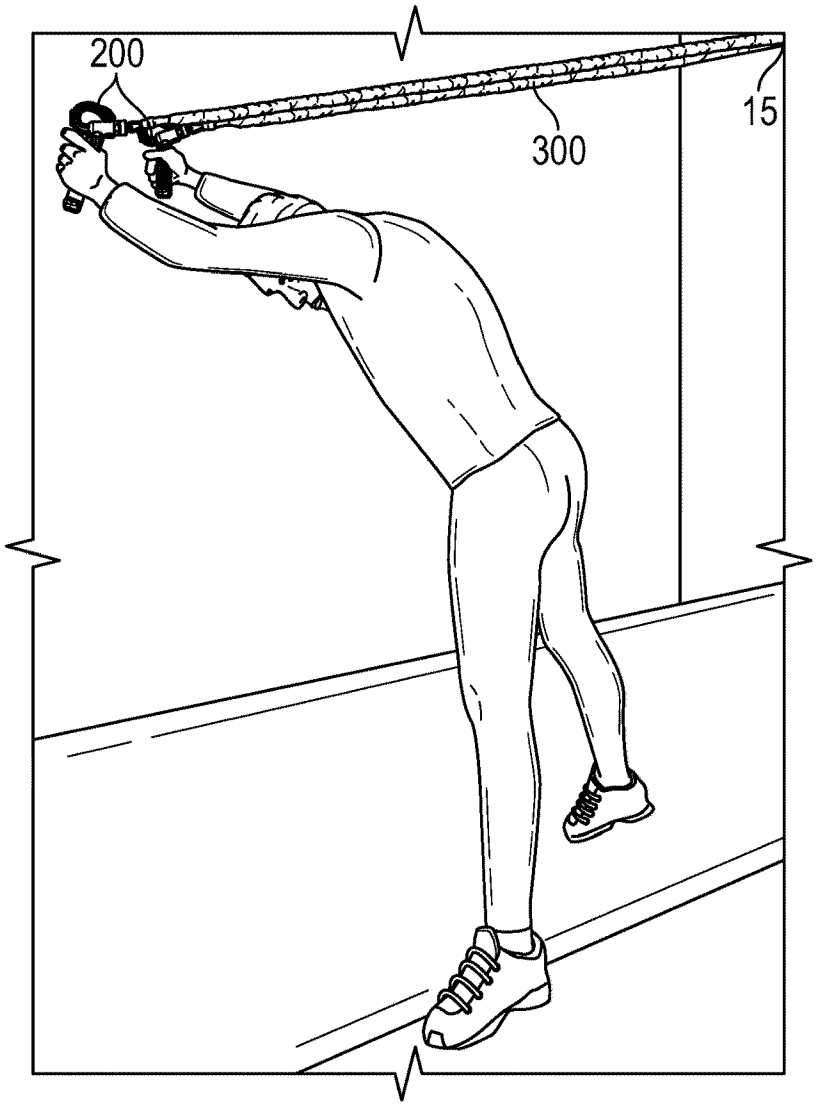
Figure 26:
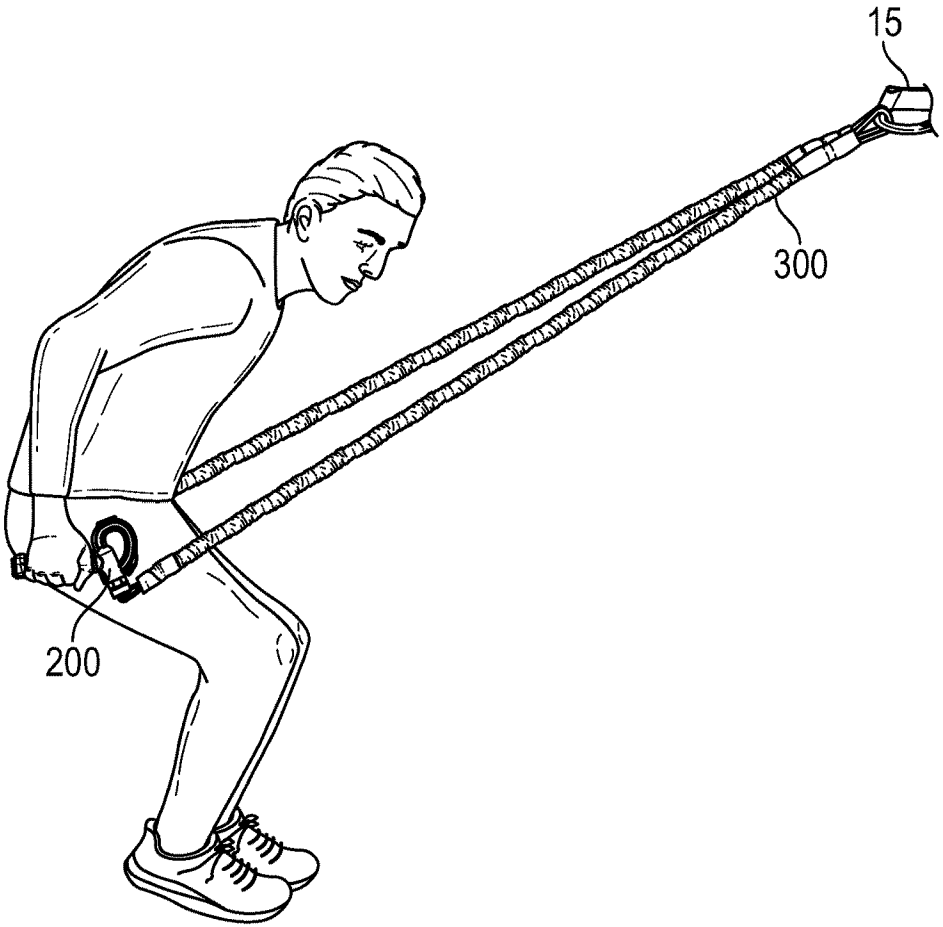
Figure 28:
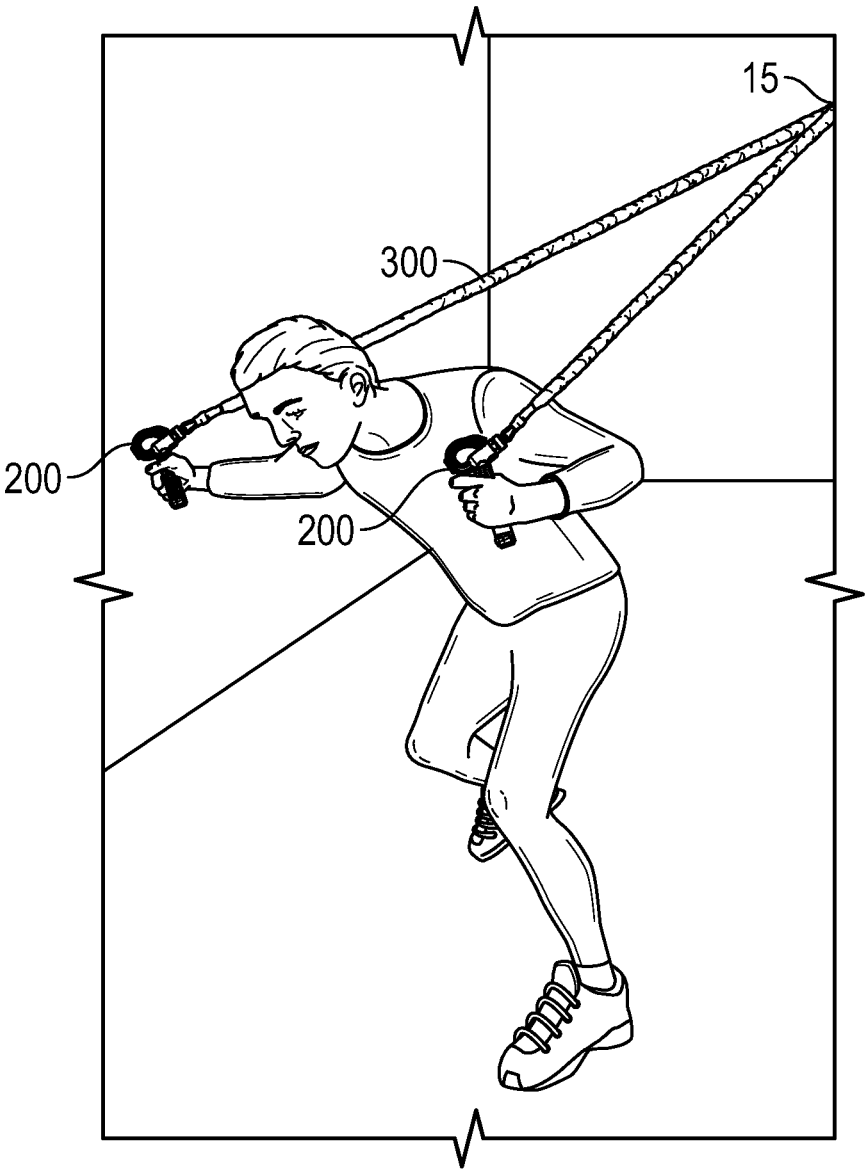

As shown in FIGS. 26-28, the long exercise cord 300 may be connected to a ring 15. The ring 15 may be connected to a daisy chain 500 (shown in 9). A user may move the handles 200 against the resistance of exercise cord 300. For example, a user may perform rows or burpees (FIG. 26), overhead triceps extensions (FIG. 27), and/or boxing/punching style movements (FIG. 28).

Figure 30:
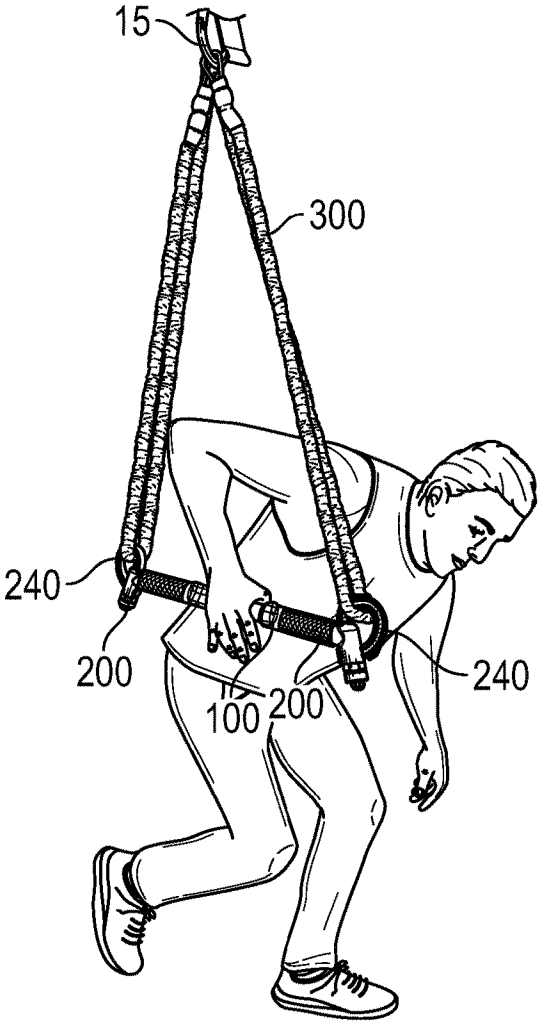
Figure 29:
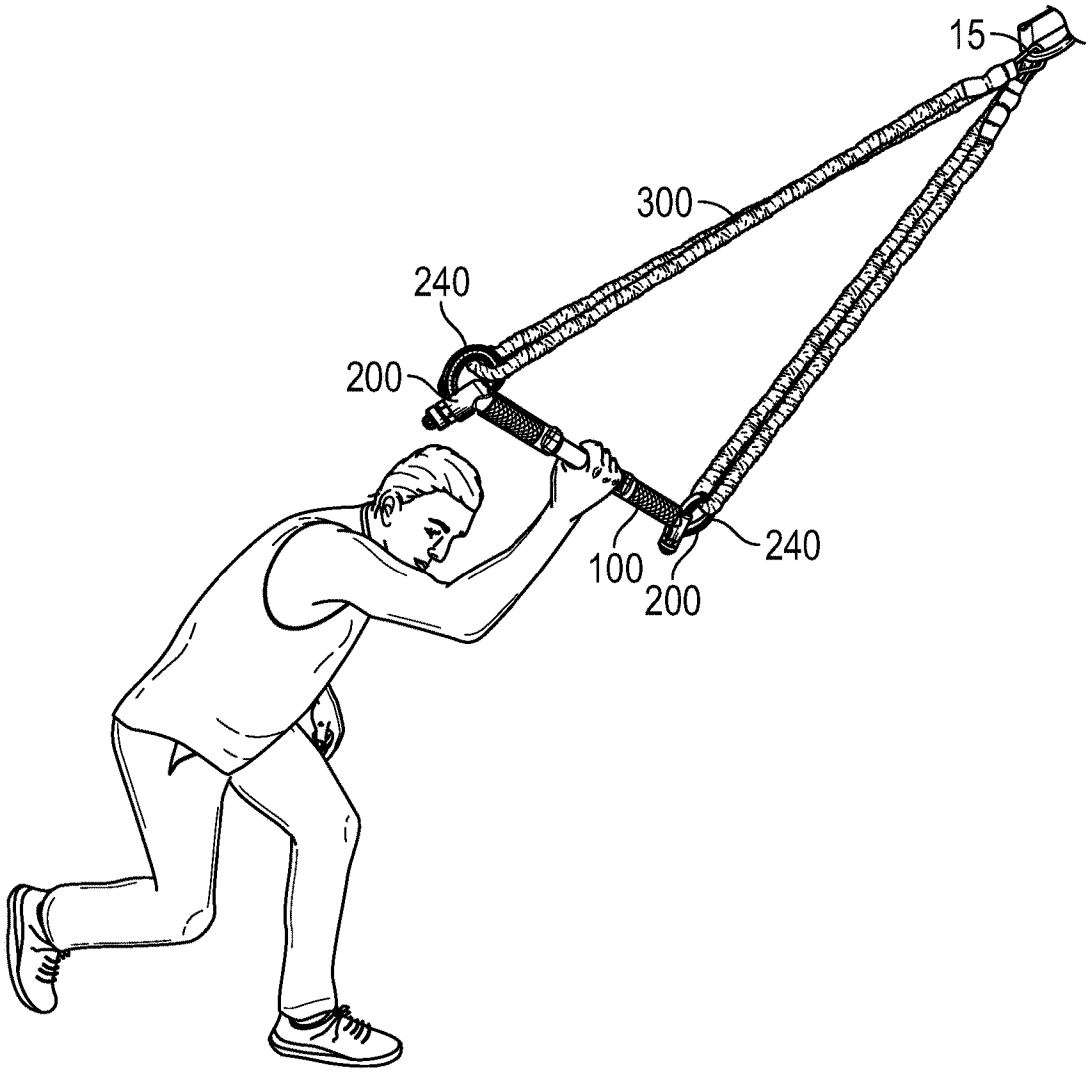

In some exercises, the pair of handles 200 may be connected with bar 100, as shown in FIG. 7. As shown in FIGS. 29 and 30, a user may pull against the resistance of the exercise cord 300. For example, a user may pull backward while grasping the bar 100 (FIG. 29) or pull or push downward while grasping the bar 100 (FIG. 30). In addition, it is understood that a user may utilize the bar 100 and exercise cord 300 as an unstable support. For instance, a user may place their feet upon the bar while performing a pushup to further engage the user's core. More particularly, bar 100 is supported above the ground. The user may utilize the bar 100 as an unstable support that pivots about its point of connection. The user may alternate extending or drawing in their legs while supported upon their hands. In some embodiments, a short exercise cord may be connected to the handles 200 and suspended from an overhead support such that a user may perform pull-ups while grasping the bar 100 and pair of handles 200. The short exercise cord has a strength sufficient to support a user's weight and may have a length of 2.5 to 3.5 feet. During operation, a user's core is engaged to compensate for the unstable and elastic movement of the bar 100 and pair of handles 200.

Figure 32:
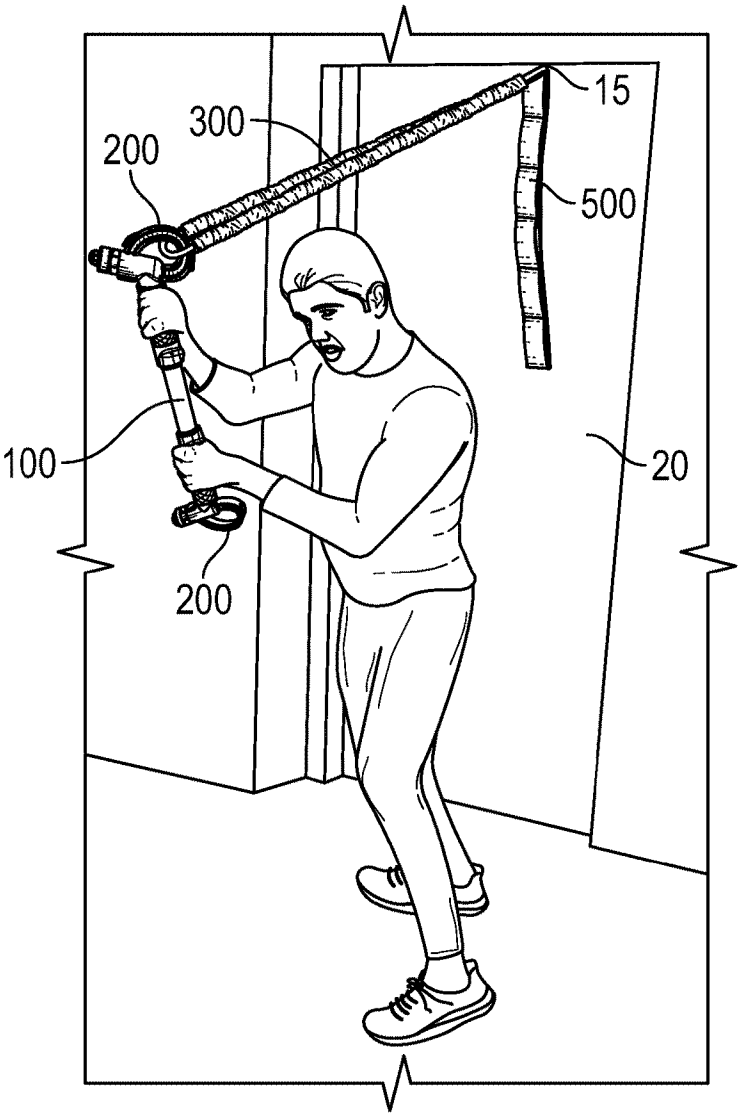
Figure 31:
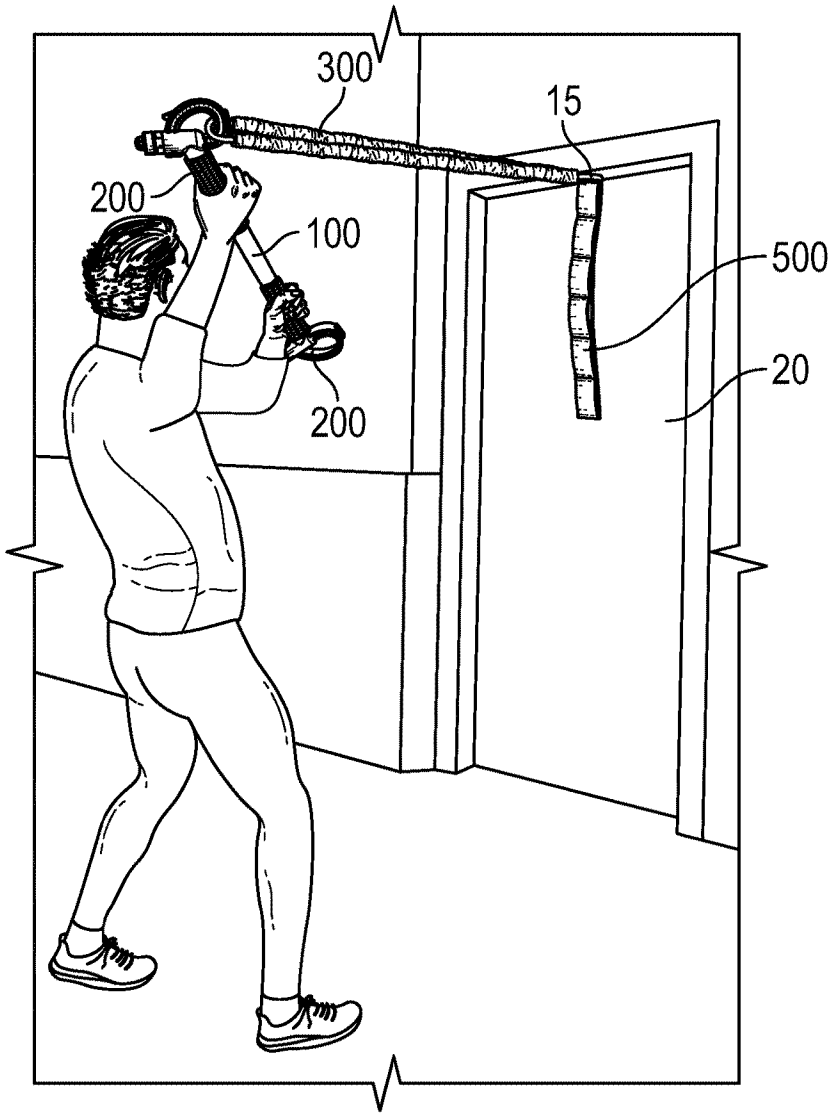

The exemplary exercises shown in FIGS. 31 and 32 utilize the configuration shown in FIG. 8. Long exercise cord 300 is connected to ring 15. Ring 15 may be connected to daisy chain 500. As shown in FIG. 31, a user may move the connected handle 200 against the resistance of exercise cord 300 in a rearward direction. For example, such actions may simulate resistance of reeling in a fish on a fishing pole. As shown in FIG. 32, a user may move the connected handle 200 in a forward direction. For example, such actions may simulate resistance of chopping wood. Ring 15 may be connected at a lower point, such as knee height, for conducting core exercises.

Figure 34:
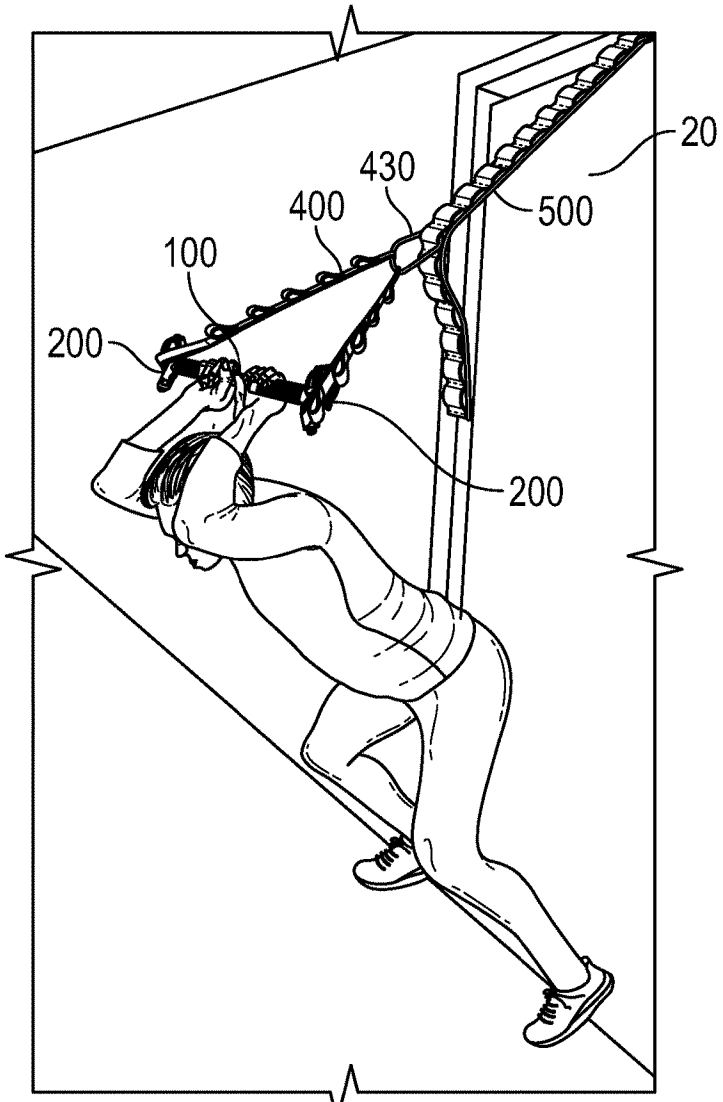
Figure 33:
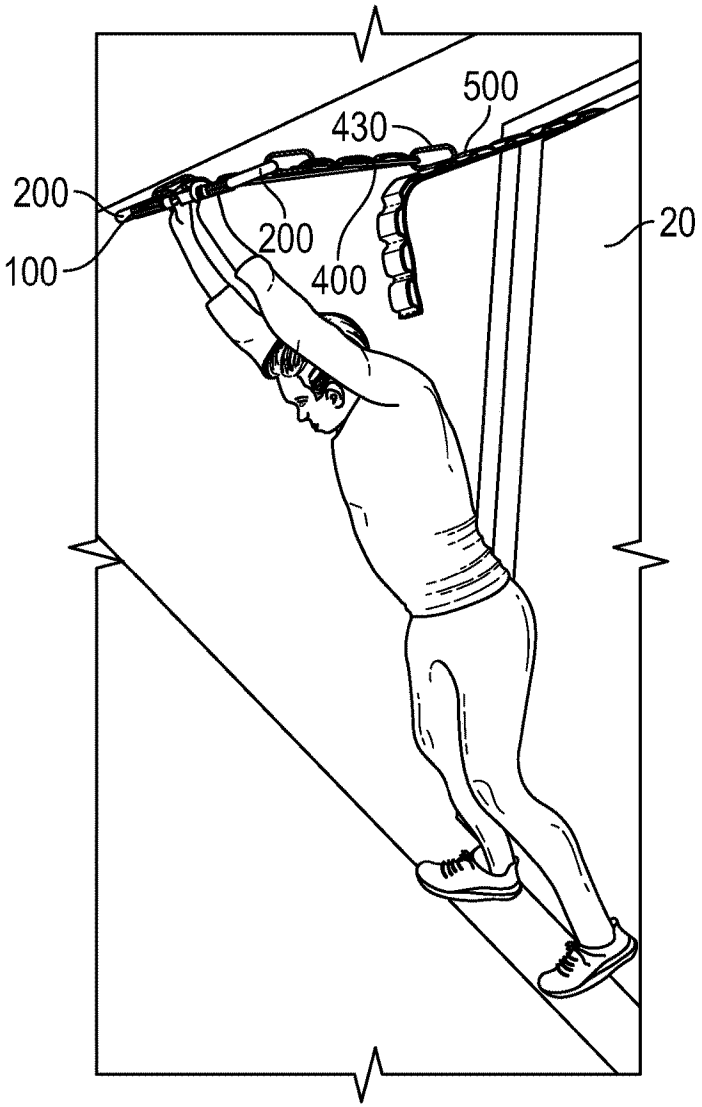
Figure 35:
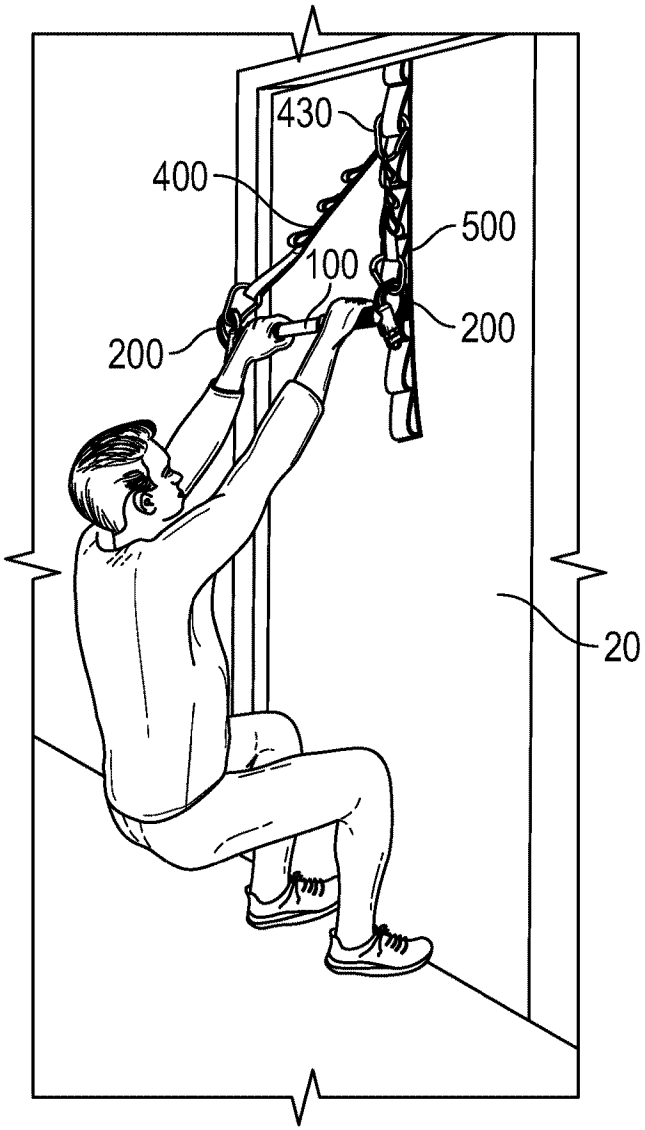

The exemplary exercises shown in FIGS. 33-35 utilize the configuration shown in FIG. 11. The bar 100 and handles 200 are connected to a rabbit runner 400 connected to a daisy chain 500. Depending on the desired exercises, the rabbit runner 400 may be connected to a high-anchor point, such as clavicle height, a mid-anchor point, such as umbilical height, or a low-anchor point, such as knee height. As shown in FIGS. 33 and 34, a user may extend and retract against a length of the rabbit runner 400 and daisy chain 500. As shown in FIG. 35, a user may pull downward against the rabbit runner 400 in a squatting position.

Figure 36:
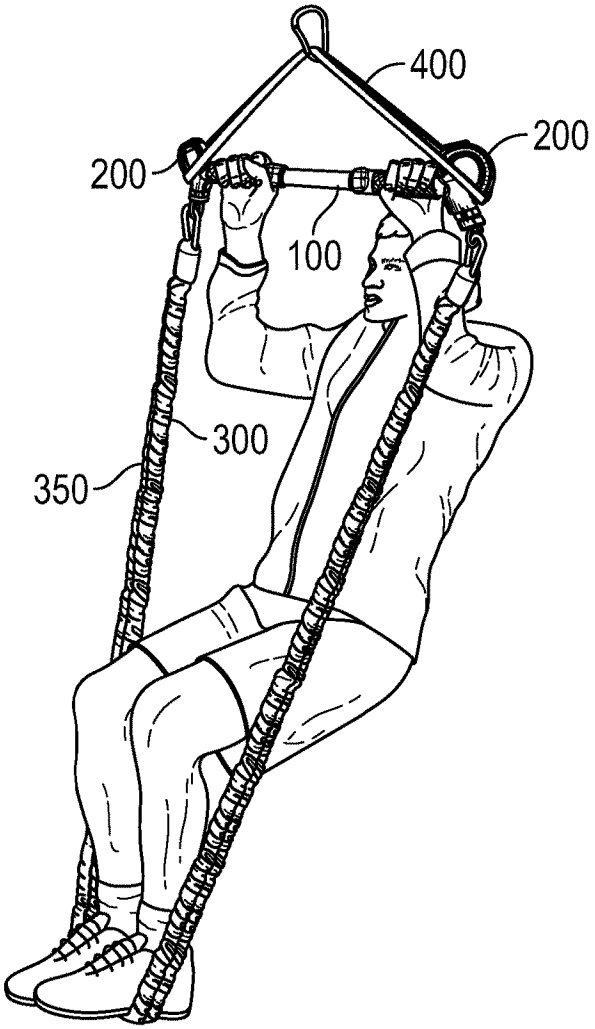

In FIG. 36, the bar 100 and handles 200 are connected to rabbit runner 400. Rabbit runner 400 is connected to an overhead support. Two long exercise cords 300, 350 are suspended from the handles 200. In some embodiments, both ends of a single exercise cord may be connected to of the handles 200 and looped through the other handle. The user may stand or sit upon the long exercise cords 300, 350 and grasp the bar 100 and handles 200. The user may perform pullups assisted by the elastic energy within the long exercise cords 300, 350.

Figure 37B:
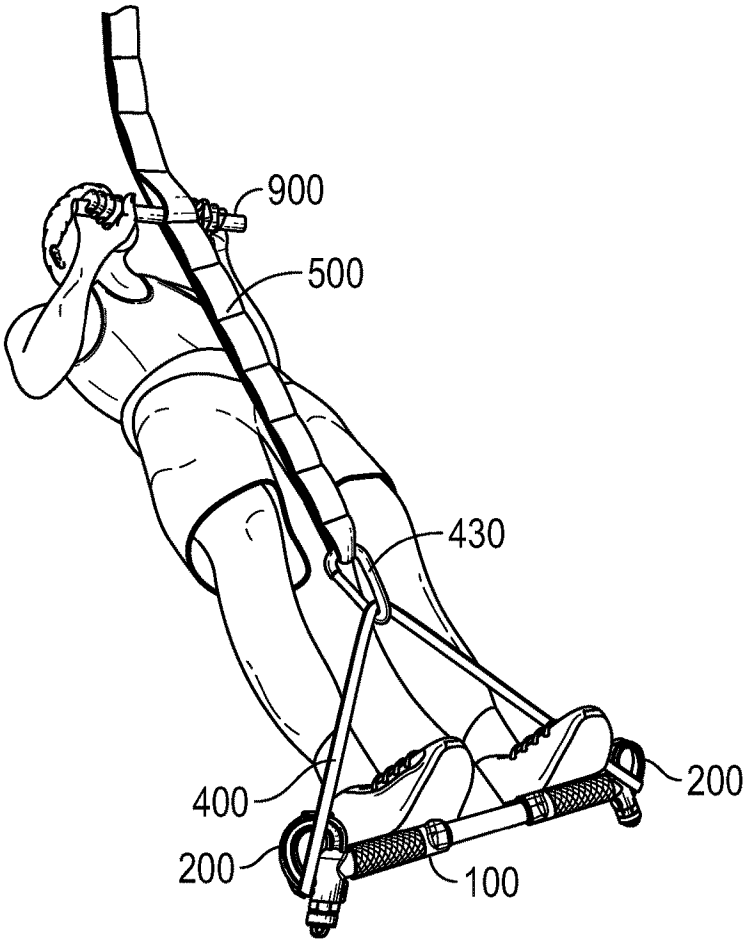
Figure 37A:
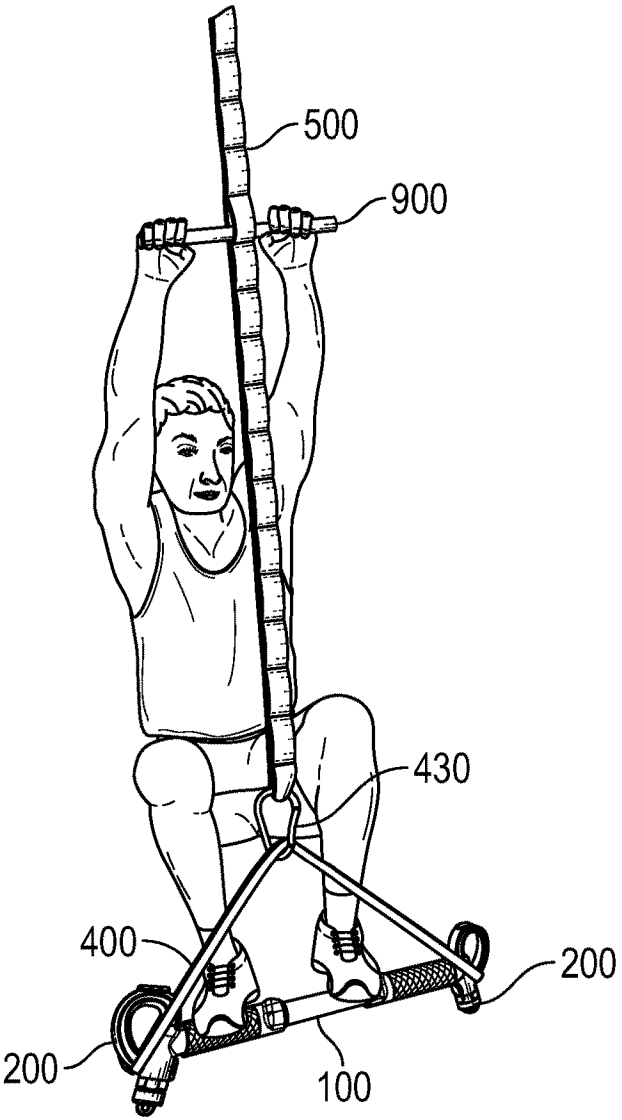

In FIG. 37A, the bar 100 and handles 200 are connected to rabbit runner 400. Rabbit runner 400 is connected to a loop of daisy chain 500. Bar 100 is supported above the ground. A handlebar 900 is inserted into a loop of daisy chain 500 above bar 100. A user stands upon bar 100 and grasps handlebar 900. The user alternates between a crouched position (FIG. 37A) and pulls upward and extends their legs in an extended position (37B) and swings upon daisy chain 500.

Figure 38:
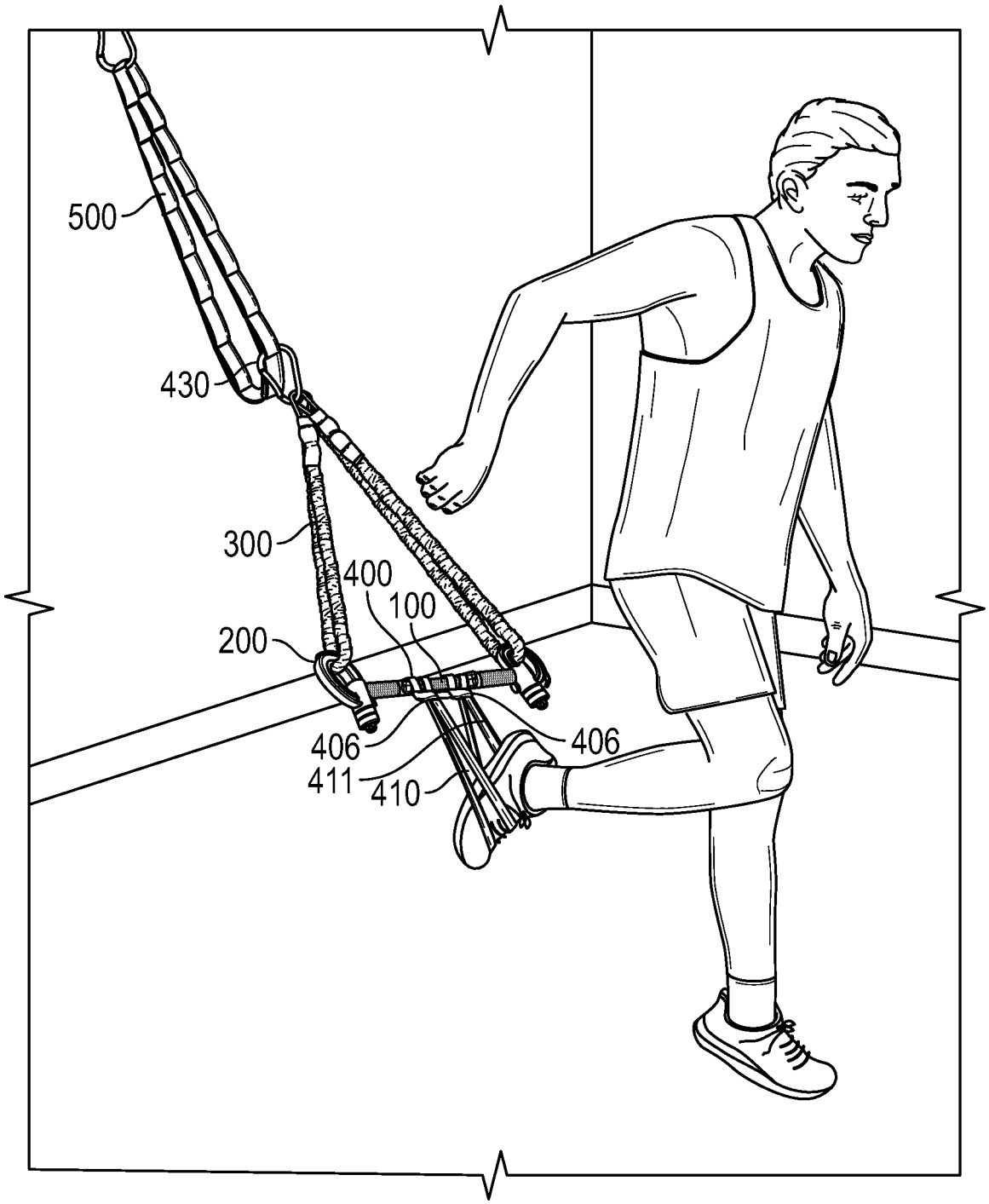

In FIG. 38, the bar 100 and handles 200 are connected to the long exercise cord 300. The long exercise cord 300 may be connected to the daisy chain 500 via a carabiner 430. The bar 100 is supported adjacent to the ground. The rabbit runner 400 is connected around the bar 100. More particularly, the first loop 410 and the second loop 411 of the rabbit runner 400 may wrap around the bar 100 and be passed back through a pair of center loops 406. The first loop 410 and the second loop 411 form foot cradles. By way of example, a user may place their feet within one or both of the foot cradles to perform exercises. A user may sweep their leg sideways against the resistance of the long exercise cord. The user may kick and/or jump against the resistance of the long exercise cord 300. A user may perform a pushup to further engage the user's core.

Figure 39:
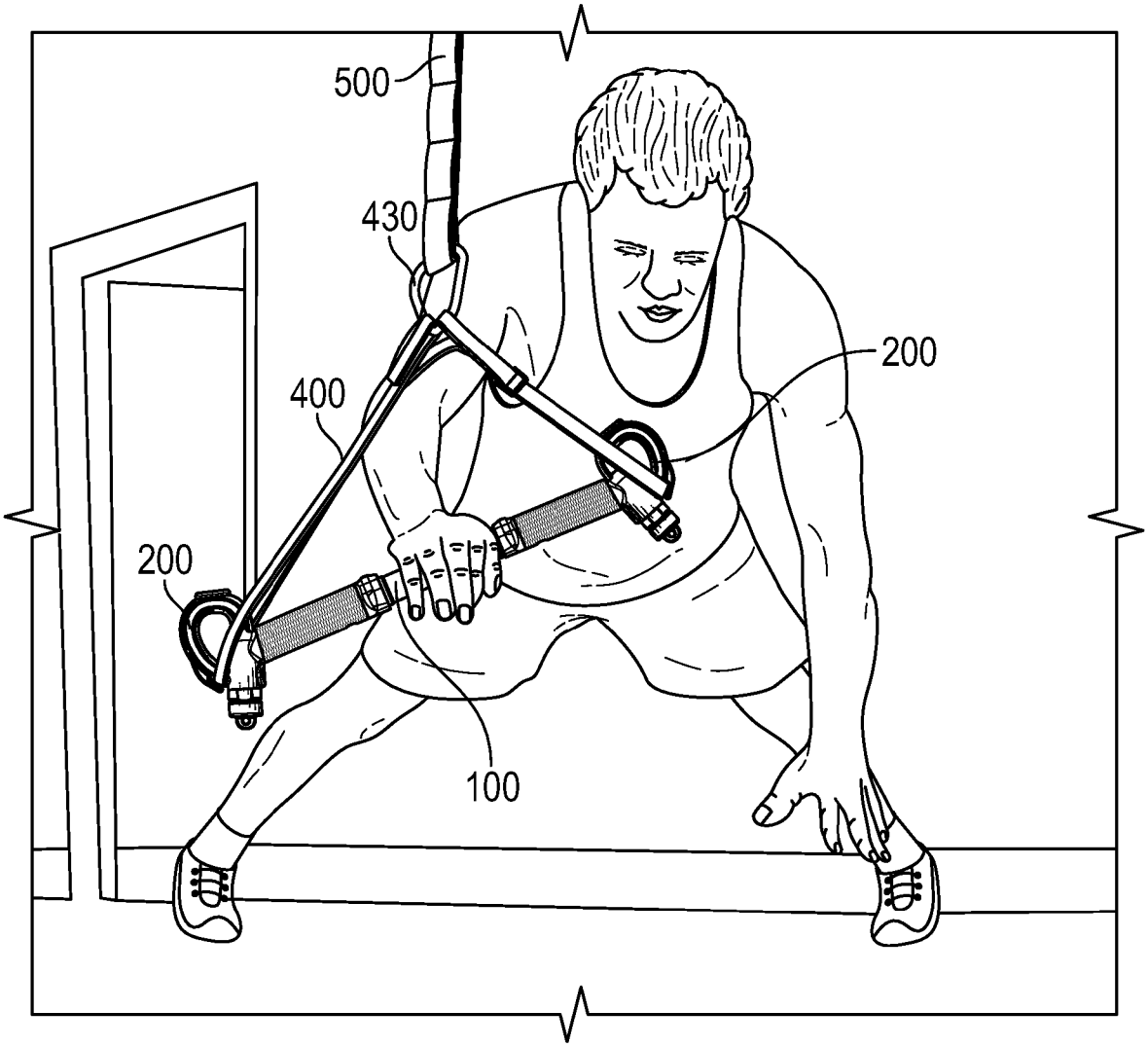
Figure 40:
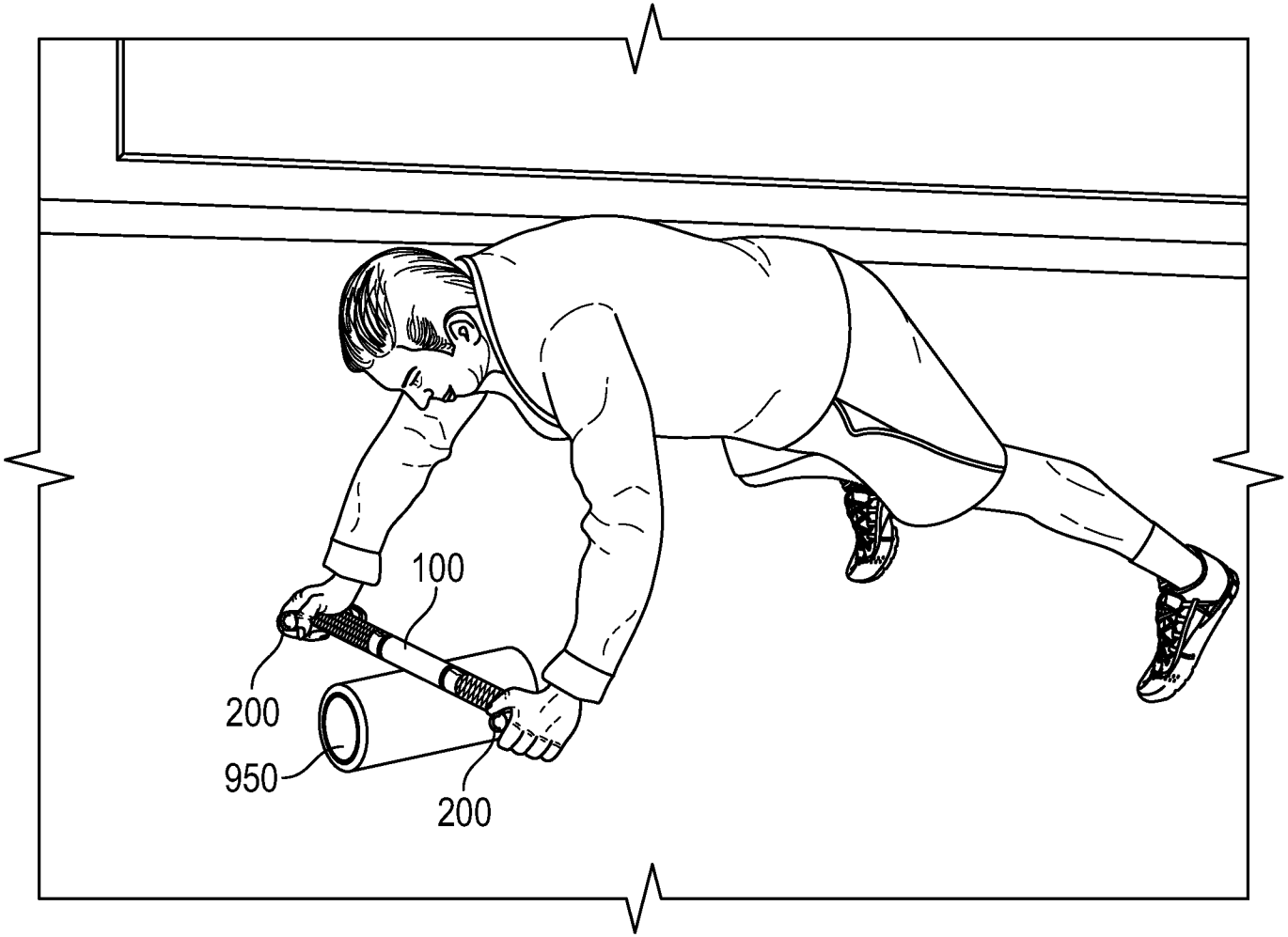

In FIG. 39, the bar 100 and handles 200 are connected to rabbit runner 400. Rabbit runner 400 is connected to a loop of daisy chain 500. Bar 100 is supported above the ground. The user may utilize the bar 100 as an unstable support that pivots about daisy chain 500. A user may place their feet upon the bar 100 while performing a pushup to further engage the user's core. The user may alternate extending or drawing in their legs while supported upon their hands. As shown in FIG. 39, a user may place on hand upon the bar 100 to conduct a dips or pushups. In FIG. 40, the handles 200 are connected to the ends of the bar 100 but not connected to a rabbit runner 400 (shown in FIGS. 38-39). The bar 100 is placed on an unstable surface, such as a ball or a cylinder 950, and a user performs pushups.

Figure 41:
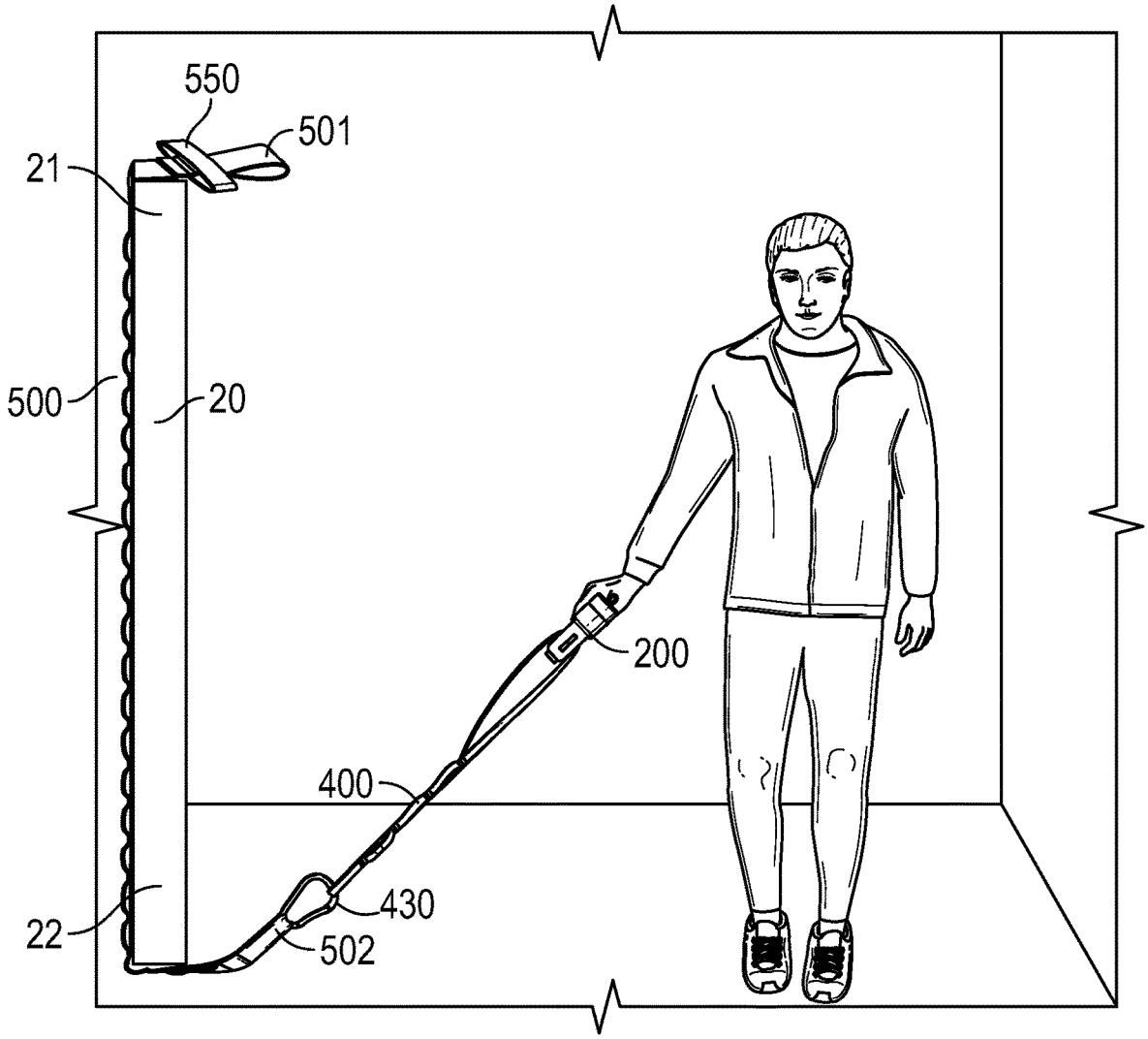

As illustrated in FIG. 41, in some embodiments, daisy chain 500 is sufficiently long to wrap around a door 20. Daisy chain 500 may be at least eight feet in length. In some environments, a gap underneath a door may be too large for an anchor to be placed at a bottom of the door. A user may place a door anchor 550 at a first end 501 of daisy chain 500 at a top 21 of the door 20 to be secured against a doorjamb. The daisy chain 500 wraps around an outside of the door 20 and under a bottom 22 of the door 20. First end 501 and second end 502 of daisy chain 500 are positioned on the same side of the door 20 and a user can anchor a rabbit runner 400 or long exercise cord 300 (not shown in FIG. 41) via a carabiner 430 adjacent to the bottom 22 of the door. The bar 100 and handles 200 are connected to rabbit runner 400. Exemplary exercises include ground-based resistance training.

One skilled in the art having the benefit of this disclosure will recognize that there are also numerous other physical exercises that may be practiced by utilizing the embodiments described herein, or portions or combinations thereof.

Although this disclosure has been described in terms of certain preferred embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. An exercise system comprising:

a handle having:

a shaft extending along a first axis from a first end to a second end;

a head having a top, a bottom, a front, and a rear, the top opposite the bottom, the front opposite the rear, the head being elongated having a length extending along a second axis from the front to the rear, the bottom of the head rigidly affixed directly to the second end of the shaft, wherein the first axis is not parallel to the second axis; and a spindle having a ring, the spindle positioned on the front of the head, the spindle being rotatably supported upon the head, the spindle being rotatable about the second axis.

2. The exercise system of claim 1, wherein the handle includes a loop, the loop being affixed directly to the top of the head, the loop is further affixed directly to the rear of the head, the loop extending arcuately from the top of the head to the rear of the head, wherein the loop is rigid and not rotatable.

3. The exercise system of claim 2, further comprising a bar comprising:

a first end shaped complementary to the shaft of the handle to be selectively retained with the handle;

a second end; and a body positioned between the first end of the bar and the second end of the bar.

4. The exercise system of claim 3, further comprising a daisy chain having a first end, a second end, and a plurality of loops extending towards the second end.

5. The exercise system of claim 4, further comprising a rabbit runner, the rabbit runner comprising:

a first end having a first loop;

a second end having a second loop; and a pair of center loops near a midpoint between the first end and the second end.

6. The exercise system of claim 5, wherein the rabbit runner includes one or more mid-loops between the pair of center loops and the first loop, and one or more mid-loops between the pair of center loops and the second loop.

7. The exercise system of claim 2, wherein the bottom of the head includes a finger pad positioned adjacent to the shaft and between the second end of the shaft and the spindle.

8. The exercise system of claim 7, wherein the loop is sized and configured to receive a thumb of a hand.

9. The exercise system of claim 2, wherein the loop includes a first portion and a second portion, the first portion closer to the spindle than the second portion, the first portion including a notch, a portion of the notch extends along the loop to form a slot extending along the loop.

10. The exercise system of claim 9, further comprising a wrist strap, the notch of the loop being positioned to retain the portion of the wrist strap on the first portion of the loop.

11. The exercise system of claim 2, wherein the first axis is not perpendicular to the second axis.

12. The exercise system of claim 11, wherein the first axis and the second axis are angularly offset in a range of 15 to 45 degrees.

13. The exercise system of claim 2, wherein the spindle is supported on the front of the head by a plurality of ball bearings.

14. The exercise system of claim 2, wherein the head is cylindrical-shaped.

15. An exercise system comprising:

a handle having:

a shaft extending from a first end to a second end;

a head having a top, a bottom, a front, and a rear, the top opposite the bottom, the front opposite the rear, the bottom of the head affixed to the second end of the shaft;

a spindle having a ring, the spindle positioned at the front of the head, the spindle being rotatably supported upon the head; and a loop affixed to the top of the head, the loop is further affixed to the rear of the head, the loop extending arcuately from the top of the head to the rear of the head, wherein the loop includes a first portion and a second portion, the first portion closer to the spindle than the second portion, the second portion includes a flattened profile positioned to support the handle upon a surface with the shaft at an acute angle with respect to the surface.

16. The exercise system of claim 15, wherein the shaft includes a stabilizing pad protruding perpendicular to a length of the shaft from a side of the shaft, the stabilizing pad positioned at the first end of the shaft, the stabilizing pad being angularly aligned with the flattened profile of the loop.

17. The exercise system of claim 1, wherein the spindle further comprises a body with a top, the ring extending from the top and having a first side and second side with an aperture extending therebetween, the top having a concave shape.

18. The exercise system of claim 17, wherein the ring is integrally formed into the body of the spindle.

19. The exercise system of claim 1, further comprising one or more elastic exercise cords configured to selectively connect to the ring.

20. The exercise system of claim 19, further comprising one or more kettleballs configured to selectively connect to the one or more elastic exercise cords.

21. The exercise system of claim 19, wherein the elastic exercise cord has a length of four to nine feet.

22. A method of utilizing an exercise system, the method comprising:

attaching an elastic exercise cord to a kettleball, the elastic exercise cord including a first end with a cord loop and a second end, the kettleball including a body and a passageway extending through the body, wherein the elastic exercise cord is attached to the kettleball by passing the elastic exercise cord through the passageway and around the body and through the cord loop; and attaching a handle to the second end of the elastic exercise cord, the handle comprising a head having a length extending axially from a front to a rear, and a height perpendicular to the length, the height extending from a bottom to a top, the length being greater than the height;

a loop affixed directly to the head, wherein the loop is rigid and not rotatable;

a spindle rotatably supported upon the front of the head by a ball bearing, the spindle including a rigid ring; and a shaft having a length extending axially from a first end to a second end, the second end affixed directly to the head, the shaft sized to receive at least one hand along its length, wherein the length of the head is not parallel to the length of the shaft.

23. The method of claim 22, wherein the second end of the elastic exercise cord is attached to the spindle of the handle, the method further comprising spinning the kettleball in a circular motion around the handle.

24. The method of claim 22, further comprising:

attaching a first end of a second elastic exercise cord to the handle;

attaching a second end of the second elastic exercise cord to a support; and moving the handle against a resistance of the second elastic exercise cord.

25. The method of claim 22, further comprising:

attaching a first end of a second elastic exercise cord to the handle;

attaching a second end of the second elastic exercise cord to a second handle; and moving the second elastic exercise cord in a circular motion, the circular motion passing underneath a user.

* * * * *